US012036443B2

(12) United States Patent
Campanaro et al.

(10) Patent No.: US 12,036,443 B2
(45) Date of Patent: Jul. 16, 2024

(54) EXERCISE DEVICE SYSTEM AND METHOD OF USING SAME

(71) Applicant: Total Gym Global Corp., Carlsbad, CA (US)

(72) Inventors: Thomas J. Campanaro, Rancho Santa Fe, CA (US); Jesse T. Campanaro, San Diego, CA (US)

(73) Assignee: TOTAL GYM GLOBAL CORP., Carlsbad, CA (US)

( * ) Notice: Subject to any disclaimer, the term of this patent is extended or adjusted under 35 U.S.C. 154(b) by 252 days.

(21) Appl. No.: 17/516,950

(22) Filed: Nov. 2, 2021

(65) Prior Publication Data

US 2022/0143463 A1 May 12, 2022

Related U.S. Application Data

(60) Provisional application No. 63/223,486, filed on Jul. 19, 2021, provisional application No. 63/195,837, filed on Jun. 2, 2021, provisional application No. 63/117,915, filed on Nov. 24, 2020, provisional application No. 63/112,483, filed on Nov. 11, 2020.

(51) Int. Cl.
*A63B 24/00* (2006.01)
*A63B 21/062* (2006.01)

(52) U.S. Cl.
CPC ..... *A63B 24/0062* (2013.01); *A63B 21/062* (2013.01); *A63B 2024/0065* (2013.01)

(58) Field of Classification Search
CPC ..... A63B 24/0062; A63B 21/062; A63B 2024/0065; A63B 2210/06; A63B 2210/00
See application file for complete search history.

(56) References Cited

U.S. PATENT DOCUMENTS

| | | | |
|---|---|---|---|
| 6,780,142 | B1 | 8/2004 | Takizawa et al. |
| 7,744,546 | B2 | 6/2010 | Lee |
| 8,322,499 | B2 | 12/2012 | Schmidt et al. |
| 8,529,408 | B2 | 9/2013 | Bell et al. |
| 8,858,409 | B2 | 10/2014 | Trees |

(Continued)

FOREIGN PATENT DOCUMENTS

| | | | |
|---|---|---|---|
| CN | 201930463 | U | 8/2011 |
| CN | 105204283 | A * | 12/2015 |

(Continued)

OTHER PUBLICATIONS

International Search Report in corresponding PCT/US20210058636, dated Mar. 4, 2022 (14 pgs).

*Primary Examiner* — Sundhara M Ganesan
*Assistant Examiner* — Jacqueline N L Loberiza
(74) *Attorney, Agent, or Firm* — Procopio, Cory, Hargreaves & Savitch LLP

(57) ABSTRACT

An exercise device system comprising a tower; a support structure inclinable at different angles relative to the tower; a movable user support platform movably associated with the support structure for movement relative to the support structure; a pulley system associated with the movable user support platform; a cable extending through the pulley system and including opposite ends; exercise device handles coupled to the opposite ends of the cable, whereby movement of the handles causes movement of the movable user support platform relative to the support structure.

26 Claims, 29 Drawing Sheets

(56) References Cited

U.S. PATENT DOCUMENTS

| | | | | |
|---|---|---|---|---|
| 9,975,024 | B1 | 5/2018 | Potter | |
| 10,967,220 | B2 | 4/2021 | Gouzenko | |
| 11,541,264 | B1 * | 1/2023 | Mallard | A63B 21/169 |
| 11,547,917 | B2 | 1/2023 | Xing et al. | |
| 2002/0132706 | A1 * | 9/2002 | Sleamaker | A63B 21/154 482/95 |
| 2004/0166998 | A1 | 8/2004 | Campanaro et al. | |
| 2005/0085348 | A1 | 4/2005 | Kiefer et al. | |
| 2007/0203004 | A1 * | 8/2007 | Campanaro | A63B 23/03541 482/142 |
| 2009/0062072 | A1 | 3/2009 | Packham | |
| 2012/0094804 | A1 | 4/2012 | Bell et al. | |
| 2013/0128054 | A1 * | 5/2013 | Densham | H04N 7/181 348/169 |
| 2015/0196442 | A1 | 7/2015 | Heil | |
| 2015/0343263 | A1 | 12/2015 | Sampath | |
| 2016/0346601 | A1 * | 12/2016 | Marcandelli | A63B 23/0244 |
| 2017/0246497 | A1 | 8/2017 | Barsøe et al. | |
| 2018/0064992 | A1 * | 3/2018 | Rothman | H04N 7/188 |
| 2019/0184227 | A1 | 6/2019 | Gouzenko | |
| 2019/0255374 | A1 * | 8/2019 | Constanza | A63B 24/0087 |
| 2019/0366155 | A1 | 12/2019 | Takizawa | |
| 2020/0215382 | A1 | 7/2020 | Sankot | |
| 2021/0069574 | A1 * | 3/2021 | O'Dowd | G06F 3/04815 |
| 2021/0162287 | A1 | 6/2021 | Xing et al. | |
| 2021/0245012 | A1 | 8/2021 | Kumar et al. | |
| 2021/0402256 | A1 * | 12/2021 | Huch | A63B 24/0062 |
| 2022/0008788 | A1 * | 1/2022 | Parsons | A63B 24/0062 |
| 2022/0267028 | A1 | 8/2022 | Kennett | |
| 2022/0339788 | A1 * | 10/2022 | Linkowski | B25J 9/1605 |
| 2022/0362613 | A1 | 11/2022 | Watterson et al. | |
| 2023/0097826 | A1 | 3/2023 | Sampath | |
| 2023/0181969 | A1 | 6/2023 | Cohen et al. | |

FOREIGN PATENT DOCUMENTS

| | | | | | |
|---|---|---|---|---|---|
| CN | 206454173 | U | * | 9/2017 | |
| CN | 206454173 | U | | 9/2017 | |
| DE | 202016100209 | U1 | * | 6/2016 | A63B 22/02 |
| EP | 1201269 | A2 | * | 5/2002 | A63B 21/062 |
| EP | 2949569 | A1 | | 12/2015 | |
| EP | 3821953 | A1 | * | 5/2021 | A63B 24/0087 |
| GB | 201906896 | | | 7/2019 | |
| GB | 2583958 | A | * | 11/2020 | A63B 22/0076 |
| JP | 3141437 | U | | 5/2008 | |
| KR | 100936619 | B1 | * | 1/2010 | A61H 1/024 |
| KR | 1020180083078 | A | | 7/2018 | |
| KR | 2020075175 | A | * | 6/2020 | A63B 53/02 |
| WO | 2007092987 | A1 | | 8/2007 | |
| WO | WO-2007092987 | A1 | * | 8/2007 | A63B 21/0628 |

* cited by examiner

EXERCISE DEVICE SYSTEM AND METHOD OF USING SAME

CROSS REFERENCE TO RELATED APPLICATIONS

This application claims the benefit of U.S. Provisional Patent Application No. 63/223,486, filed Jul. 19, 2021, U.S. Provisional Patent Application No. 63/195,837, filed Jun. 2, 2021, U.S. Provisional Patent Application No. 63/117,915, filed Nov. 24, 2020, U.S. Provisional Patent Application No. 63/112,483, filed Nov. 11, 2020, under 35 U.S.C. 119. All of the above patent applications are incorporated by reference herein.

FIELD OF THE INVENTION

The present invention relates to exercise devices.

SUMMARY OF THE INVENTION

An aspect of the invention involves an exercise device system comprising a tower; a support structure inclinable at different angles relative to the tower; a movable user support platform movably associated with the support structure for movement relative to the support structure; a pulley system associated with the movable user support platform; a cable extending through the pulley system and including opposite ends; exercise device handles coupled to the opposite ends of the cable, whereby movement of the handles causes movement of the movable user support platform relative to the support structure.

One or more implementations of the aspect of the invention described immediately above include one more of the following: the tower includes a top and the exercise device system includes a foot platform with a top, and further comprising one or more modular monitor mounts adjustably coupled to at least one of the top of the tower and the top of the foot platform; the top of the tower includes a slot configured to receive a bottom of a monitor or a bottom of a monitor mount; the monitor mount includes a pivot member that allows a mounted monitor to pivot downwards and upwards; the exercise device system includes a foot platform including a cap that is actuatable to release the foot platform and replace it with a different accessory; the movable user support platform includes a weight-receiving section therein; the movable user support platform includes a recess, the pulley system includes a pulley in the recess, and member covering the recess and the pulley in the recess; the tower includes at least one of a rear and a side with a weight rack; the tower includes a plurality of accessory attachment members configured to attach a plurality of accessories thereto; a carriage movably coupled to the support structure to move vertically with respect to the tower to incline the support structure at different angles relative to the tower, the tower including displayed incline levels and the carriage including a window that the displayed incline level can be seen through; a carriage movably coupled to the support structure to move vertically with respect to the tower to incline the support structure at different angles relative to the tower, the carriage including handle docking stations that exercise handles for the exercise device system are dockable within; the exercise device system is one of numerous versions of the exercise device system, the numerous versions having distinguished by one or more of a high-definition monitor, a left fascia, a right fascia, a 360 degree projector/high-def camera, a smart weighing scale, a 3D body scan, a fascia projection screen, and full storage of the tower, the support structure, and the movable user support platform; the exercise device handles each include a rechargeable battery, the exercise device system includes a cabinet that stores the tower, the support structure, and the movable user support platform when not in use, and includes magnetic and charging receptacles that magnetically receive and charge the rechargeable batteries of the exercise device handles; at least one of the support structure and the movable user support platform include a rechargeable battery, the exercise device system includes a cabinet that stores the tower, the support structure, and the movable user support platform when not in use and charges the rechargeable battery of at least one of the support structure and the movable user support platform; a 360 degree projector configured to project an image on a surface and a detection system that detects a viewing orientation of a user based on an exercise a user is doing, and, based on the detected viewing orientation, projects information on an ideal surface of multiple possible surfaces to optimize the user's experience; a skeletal tracking system configured to track a plurality of body points via one or more cameras, one of more of stereo scopic, RGP imaging, IR, and LiDAR, and one or more of Open Pose, Dense Pose, and Cubemos Skeletal Tracking SDK; the tower includes a top and the exercise device system includes a foot platform with a top, and the one or more cameras are located at or adjacent to the top of the tower and at the top of the foot platform; the movable user support platform includes an integrated fabric pressure mapping system to determine and track posture of the user; one or more of the support structure and the movable user support platform include a plurality of IR LEDs, and the exercise device system includes one or more depth cameras to determine the angle of the support structure, and the velocity and acceleration of the movable user support platform; the exercise device handles include integrated IR LEDs; the exercise device handles each include a rechargeable battery and charging contacts; the exercise device handles each include Inertial Measurement Unit sensors; the exercise device handles are configured to wirelessly stream data from the handles; a foot platform with an upper surface and a display incorporated therein; the display is a transparent flexible organic light-emitting diode (OLED) display; the display is a head-up display (HUD) using polycarbonate backed with clear projection film; a cabinet and a deployment and retraction mechanism to deploy and retract the support structure with respect to the cabinet; the deployment and retraction mechanism includes a stationary ring gear, a motor with a sun gear, and a satellite gear; the deployment and retraction mechanism includes a stationary ring gear, a motor with a sun gear, and a satellite gear; the deployment and retraction mechanism includes a stationary ring gear, and a motor and gear; the deployment and retraction mechanism includes a motor with gear, a stationary gear, and a belt drive; the deployment and retraction mechanism includes a movable strut; the exercise device system is one of numerous versions of the exercise device system, the numerous versions having a common fundamental inclined bench hub and different bases and different accessories to create a personalized, unique inclinable exercise device system; the exercise device system is one of numerous versions of the exercise device system, the numerous versions having a common fundamental inclined bench hub and different bases, different accessories, and different workout equipment to create a personalized, unique inclinable exercise device system; a modular system add-on having a high-tech display screen that conceals underlying technology while emphasizing user vitals; and/or a light-weight 3D body scan mat.

DETAILED DESCRIPTION OF PREFERRED EMBODIMENTS

Figure 1:
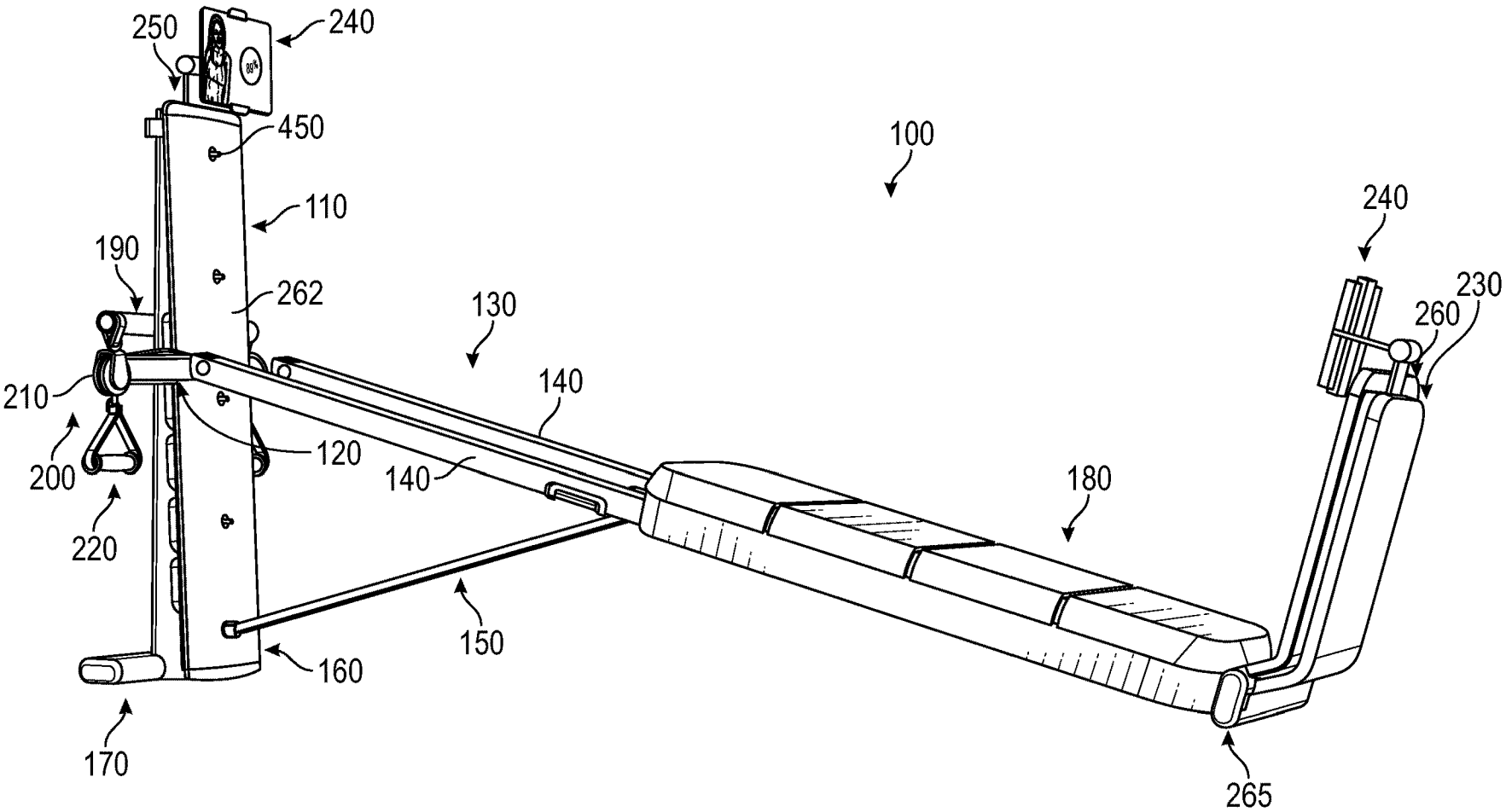
FIG. 1 is a front perspective view of an embodiment of an inclinable exercise device.
Figure 2:
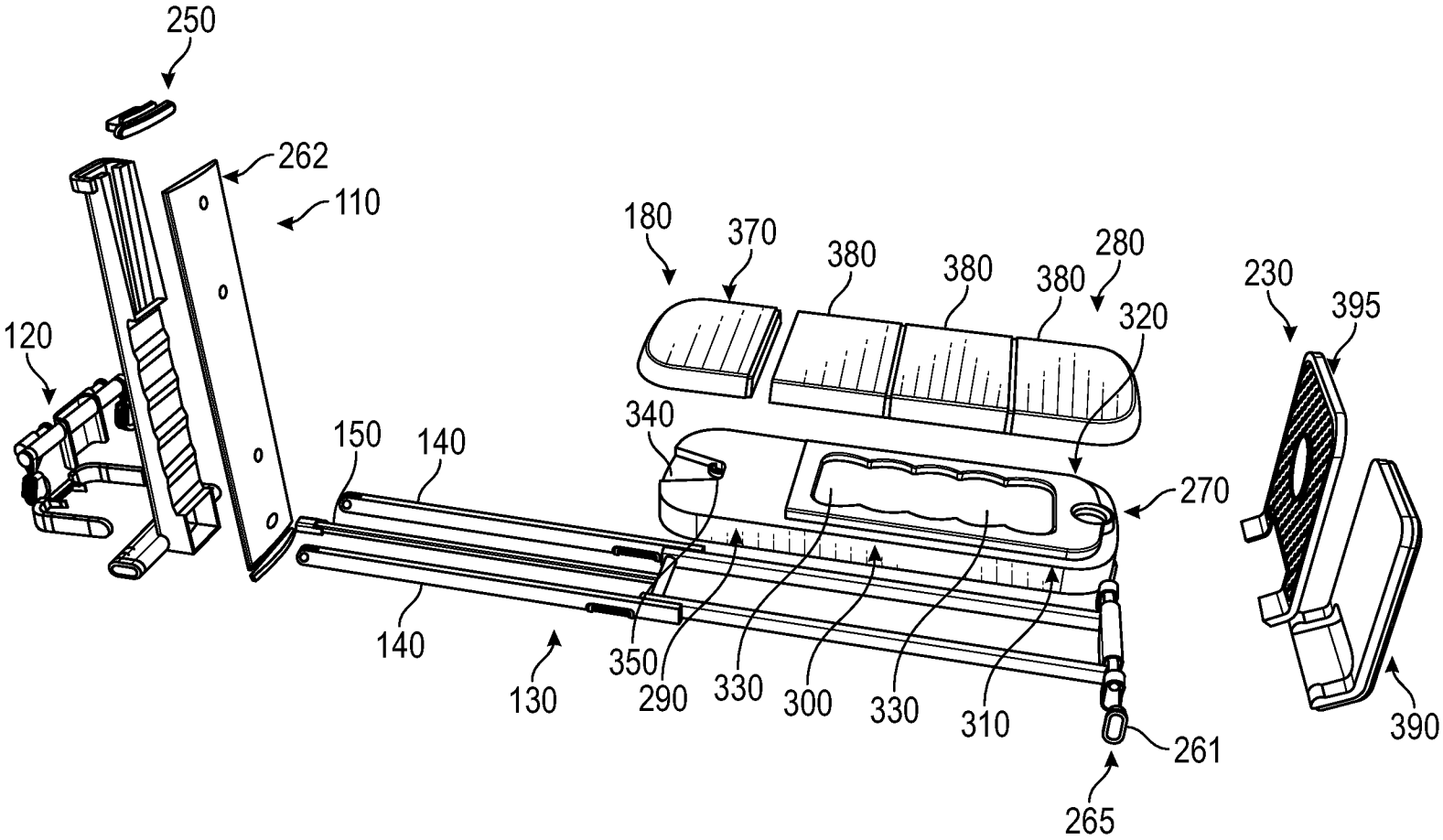
FIG. 2 is an exploded perspective view of the inclinable exercise device of FIG. 1.

With reference initially to FIGS. 1 and 2, an embodiment of an inclinable exercise device 100 includes a tower 110 with a carriage 120 vertically slidable along the tower 110. A support structure 130 includes rails 140. A strut 150 is pivotally connected to a bottom 160 of the tower 110 (or to a base 170) and pivotally coupled to rails 140. A lift-assist mechanism (not shown) may be pivotally connected at one end to the strut 150 and pivotally connected at an opposite end to the rails 140. A user support platform or glideboard 180 with rollers (not shown) rolls along the rails 140. The carriage 120 is coupled to pulley arms 190. Attached to the pulley arms 190 are pulleys 200, which are part of a pulley system. A cable 210 extends through the pulleys 200 and connects to the user support platform 180 and couples to respective exercise device handles 220 at opposite ends. The cable 210 extends through the pulleys 200 positioned on the pulley arms 190 and loops through a third pulley (not shown) attached to the user support platform 180. A foot platform 230 is coupled to a lower part of rails 140.

Figure 12:
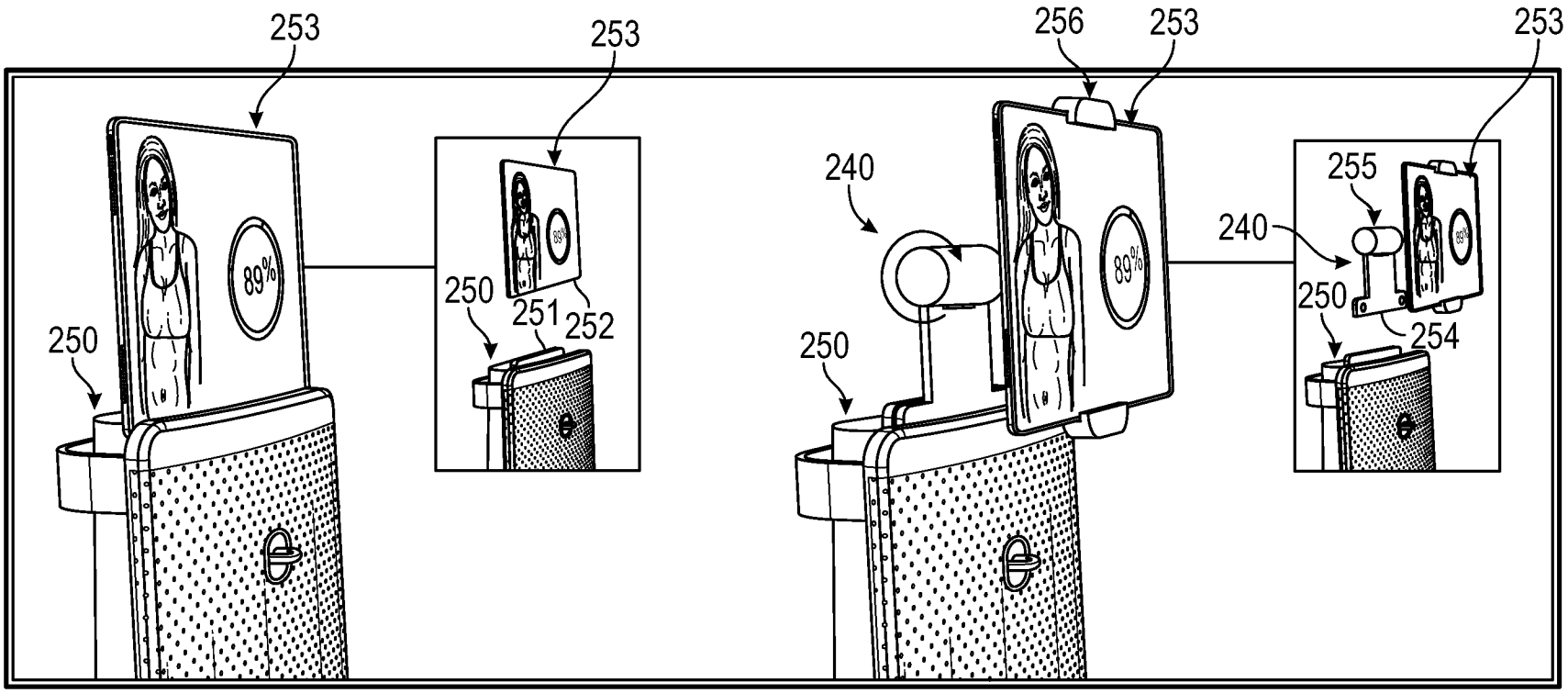
FIGS. 12-14 are perspective views of embodiment of modular monitor mounts for the top of the tower 110 and/or the top of the foot platform.
Figure 13:
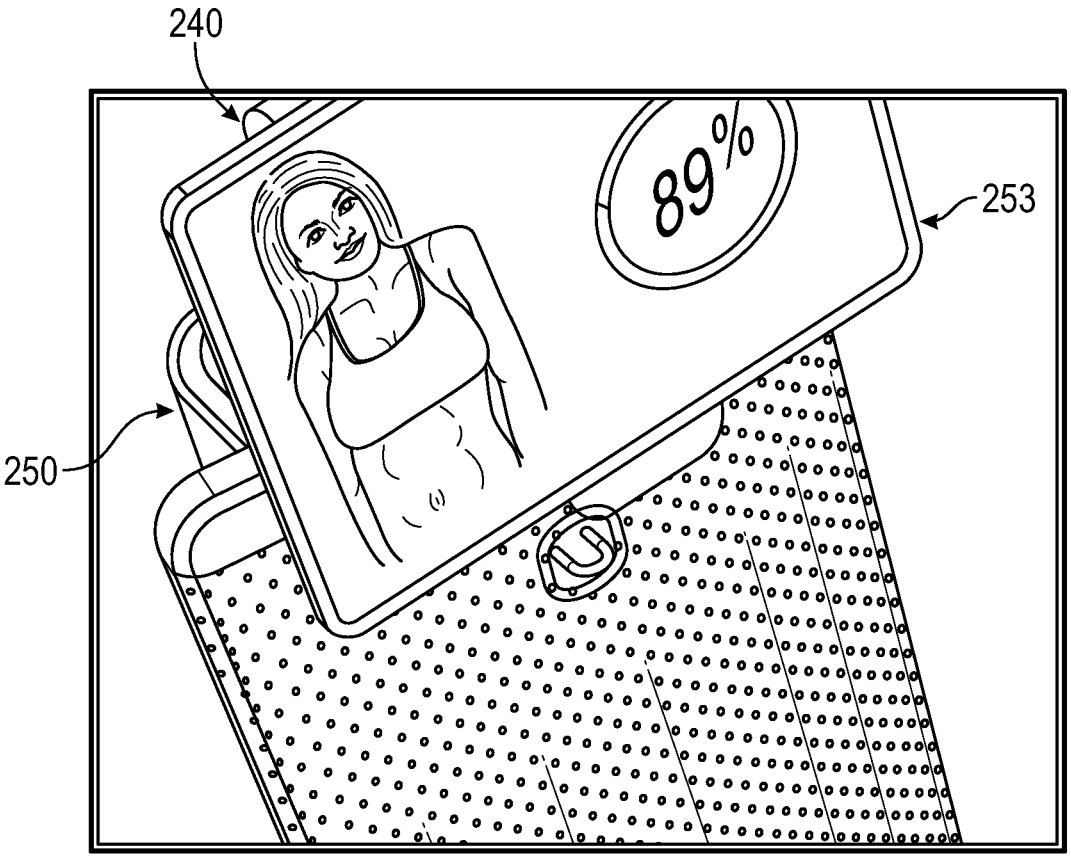
Figure 14:
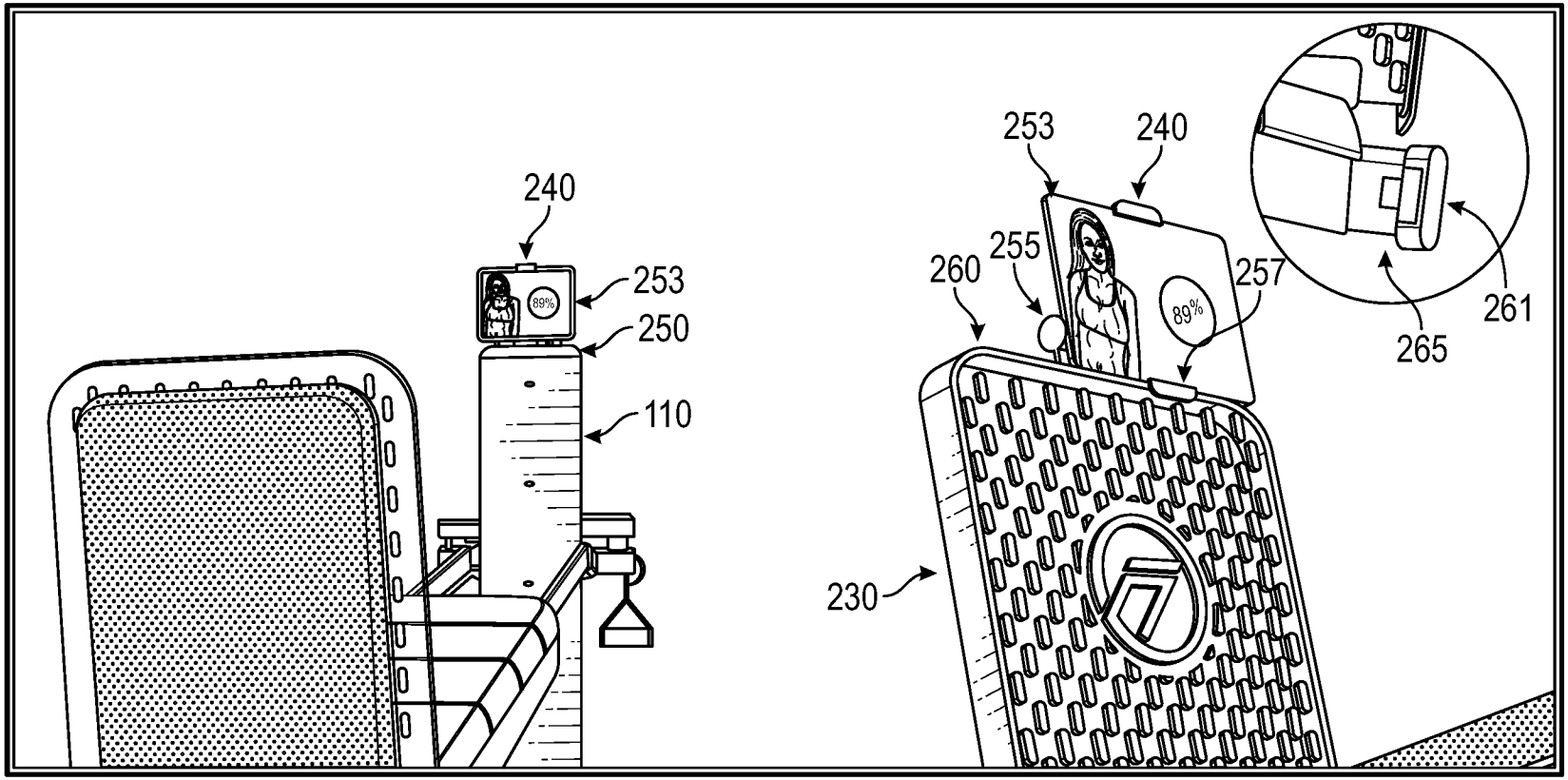

With reference additionally to FIGS. 12-14, one or more modular monitor mounts 240 are adjustably coupled to a top 250 of the tower 110 and/or a top 260 of the foot platform 230. The top 260 includes a slot 251 that may directly receive a bottom 252 of a monitor 253 or a bottom 254 of the monitor mount 240. The monitor mount 240 is fixed to the top 260 via one or more fasteners and includes a pivot member 255 that the monitor 253 is coupled to via bracket/mount accessory 256 to allow the monitor 253 to pivot downwards and upwards. The monitor mount 240 for the foot platform 230 may include, in addition to the pivot member 255, a mounting bracket 257 to attach the monitor mount 240 to the top 260 of the foot platform 230.

Also shown in FIG. 14, a cap 261 on each side of the distal base/tube 265 may be pulled outward to release the squat stand/foot platform 230 and replace it with a different accessory.

If the tower 110 is powered, the incline level may be illuminated. The tower 110 includes an angled tower plane or front cladding 262 that creates a solid stance for the exercise device 100. The inclinable exercise device 100 includes a distal base/tube 265 that the foot platform 230 is coupled to.

In use, a user adjusts the height of the carriage 110 with respect to the tower 110 so that the rails 140 are at a desired angle. The user gets on the exercise device 100 by sitting on or lying on the user support platform 180. The user pulls (or otherwise moves) the exercise device handles 220 (and cable 210), causing the user support platform 180 to move up the inclined rails 140 at a rate proportionate to the rate that the user pulls on the exercise device handles 220/cable 210. The angle of the rails 140, which may be adjusted by adjusting the height of the carriage 110 with respect to the tower 110 as described above, determines the amount of resistance (percentage of user's body weight) the user must overcome to pull the user support platform 180 and user up the inclined rails 140. As the user pulls (or otherwise moves) the exercise device handles 220 (and cable 210) toward and away from the bottom of the rails 140, the user moves up and down the inclined rails 140 on the user support platform 180.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Figure 10:
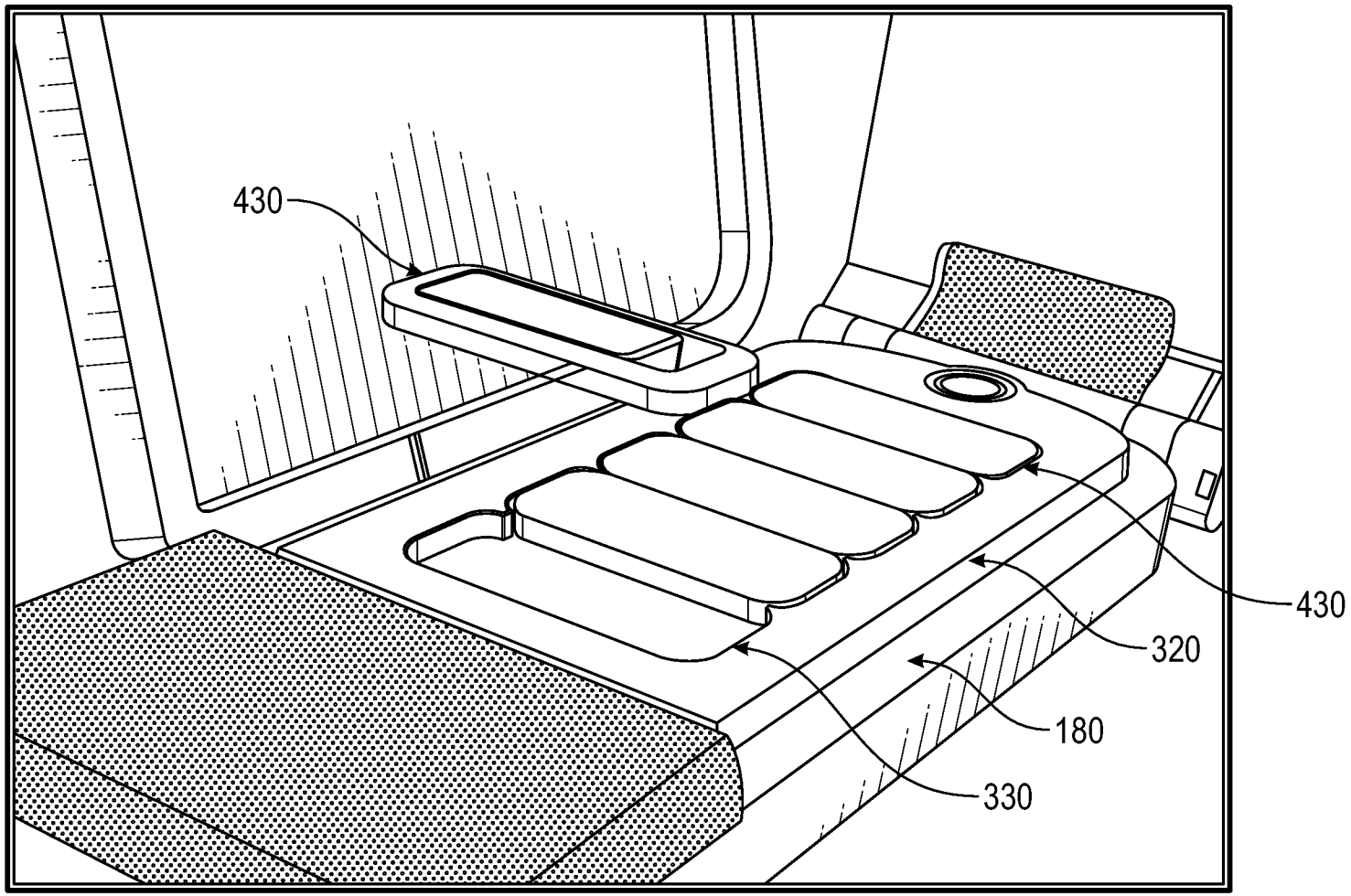
FIGS. 10 and 11 are perspective views of a weight-receiving section of the support platform of the inclinable exercise device of FIG. 1.
Figure 11:
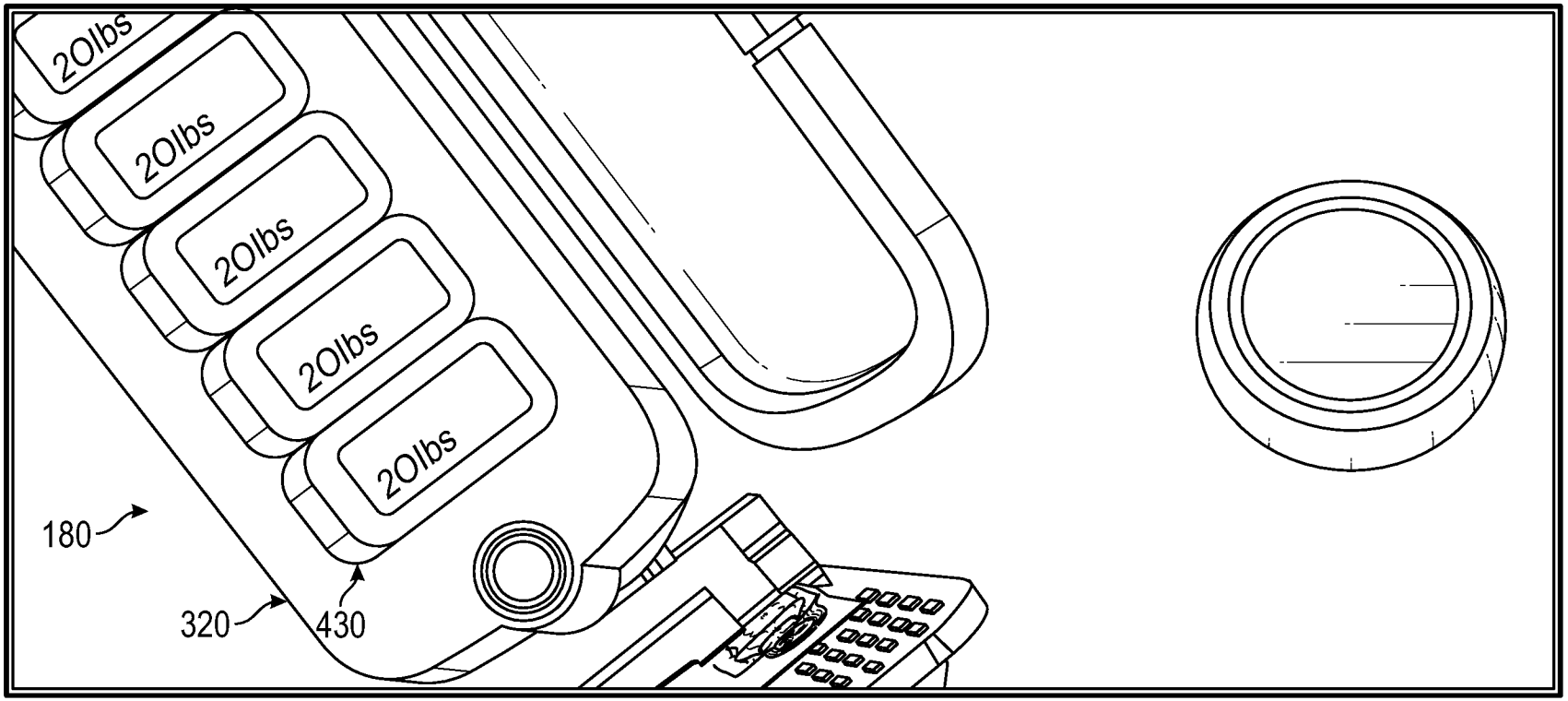

With reference to FIGS. 2, 10, and 11, the user support platform 180 of the inclinable exercise device 100 includes a bottom member/base 270 and an upholstered top member 280. The base 270 may be made of sheet metal and includes a proximal portion 290, a central portion 300, and a distal portion 310. The central portion 300 and the distal portion 310 include a thermoformed tray forming weight-receiving section 320. The weight-receiving section 320 includes a plurality of contiguous weight-receiving recesses 330. One or more of a plurality of weights 430 may be added to and removed from the weight-receiving recesses 330 of the weight-receiving section 320 of the user support platform 180 to increase/decrease resistance in the inclinable exercise device 100.

Figure 9:
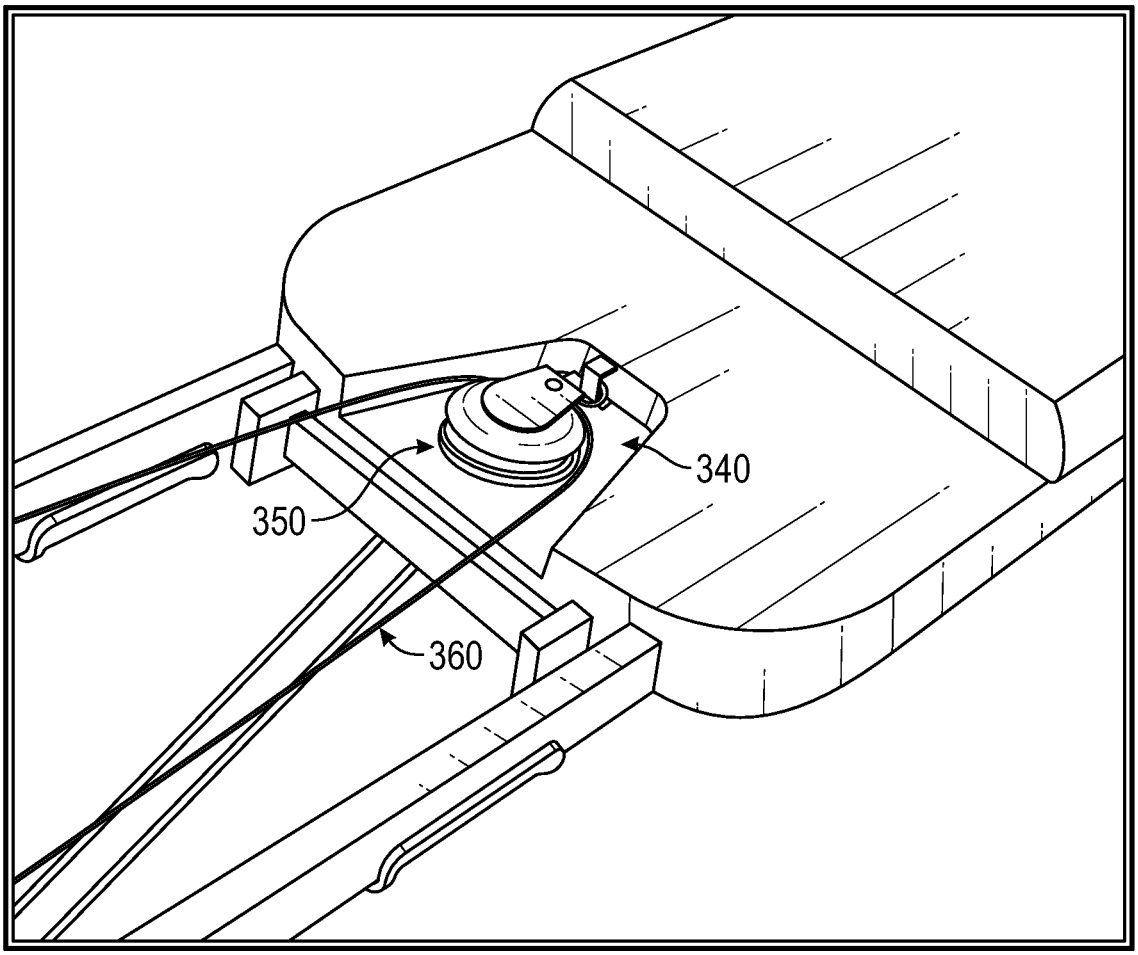
FIG. 9 is a perspective view of a proximal portion of the support platform of the inclinable exercise device of FIG. 1.

With reference additionally to FIG. 9, the proximal portion 290 includes a V-shaped recess 340 with a recessed pulley 350 disposed therein. The V-shaped recess 340 and the pulley 350 accommodate a cable 360. The top member 280 of the user support platform 180 includes a proximal headrest cushion member 370 that is hingeably coupled to the bottom member 270 for accessing the V-shaped recess 340, the recessed pulley 350, and the cable 360, and a plurality of distal cushion members 380 that form the upholstered top member 280. The foot platform 230 includes a distal/lower base 390 and a proximal/upper foot-receiving section 395 that is pivotally coupled to both the distal base 390 of the foot platform 230 and the distal base 265 of the inclinable exercise device 100.

Figure 3:
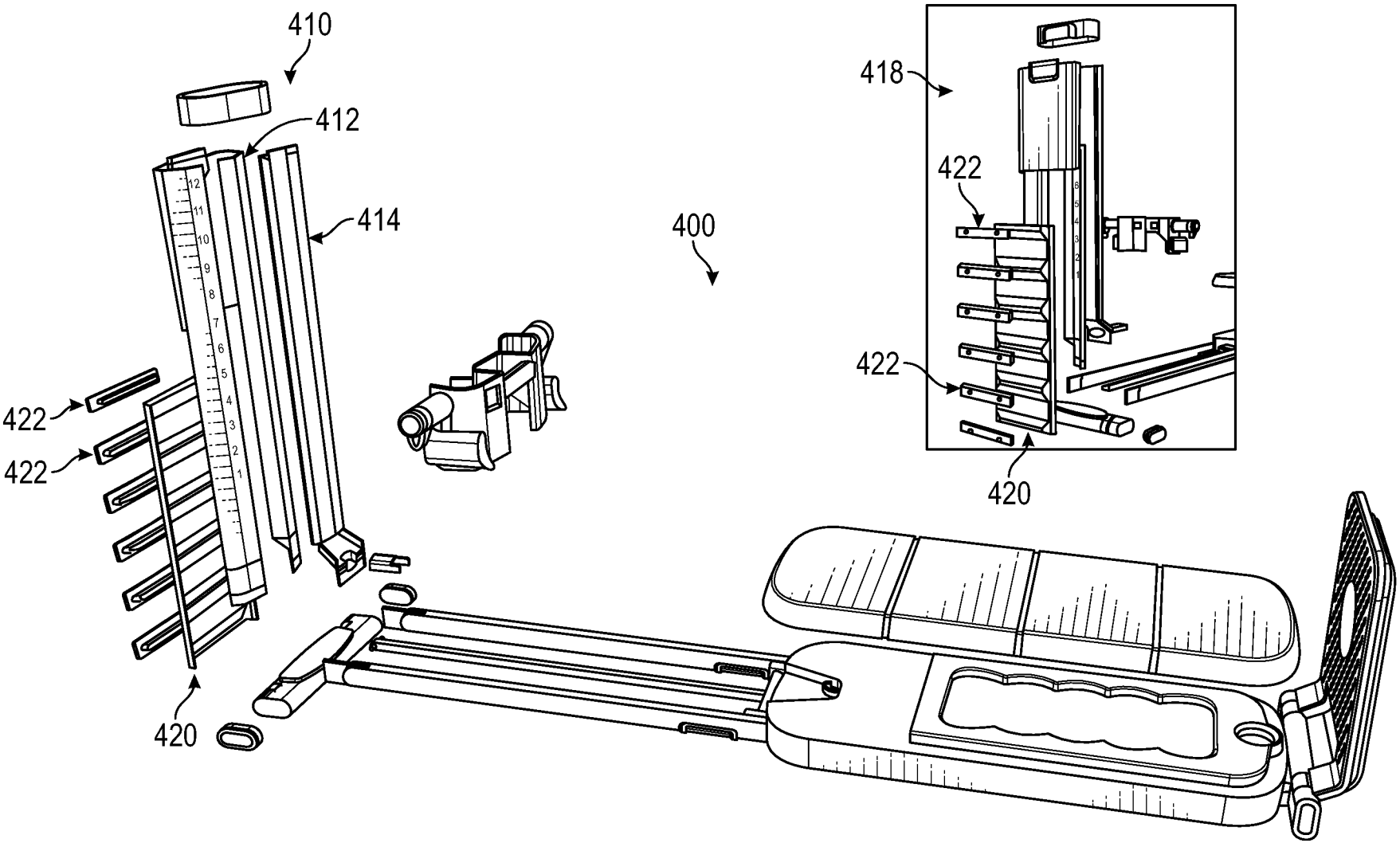
FIG. 3 is an exploded perspective view of another embodiment of an inclinable exercise device.

FIG. 3 is an exploded perspective view of another embodiment of an inclinable exercise device 400, which is similar to the inclinable exercise device 100, but shows a tower 410 with a different construction/configuration from the tower 110. The tower 410 include a front fascia 412 made of sheet metal cladding and a rail cover 414 made of sheet metal cladding. A rear 418 of the tower 410 includes a thermoformed weight rack 420 and a plurality of weight shelves 422 for holding weights to be received in the weight-receiving recesses 330 of the user support platform 180.

Figure 4:
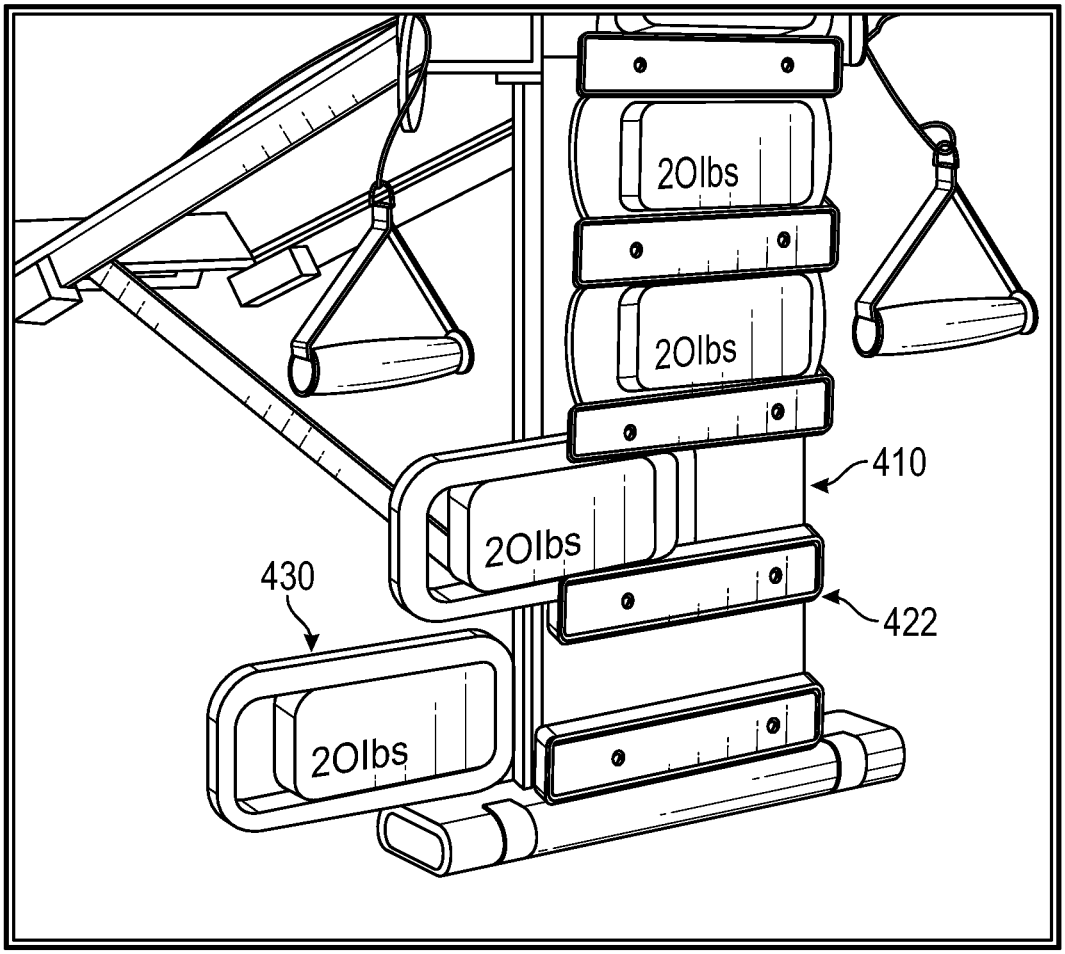
FIG. 4 is a rear perspective view of the inclinable exercise device of FIG. 1.

FIG. 4 is a rear perspective view of the tower 410 of the inclinable exercise device 400 and shows the plurality of removable weights 430 slidably received within and on the weight shelves 422. The weights 430 may be slidably removed/added laterally with respect to the weight shelves 422 as needed and added/removed to/from the weight-receiving recesses 330 of the weight-receiving section 320 of the user support platform 180. When the weights 430 are not desired to create additional resistance during exercise, they are conveniently stored in the weight shelves 422 in the tower 410.

Figure 5:
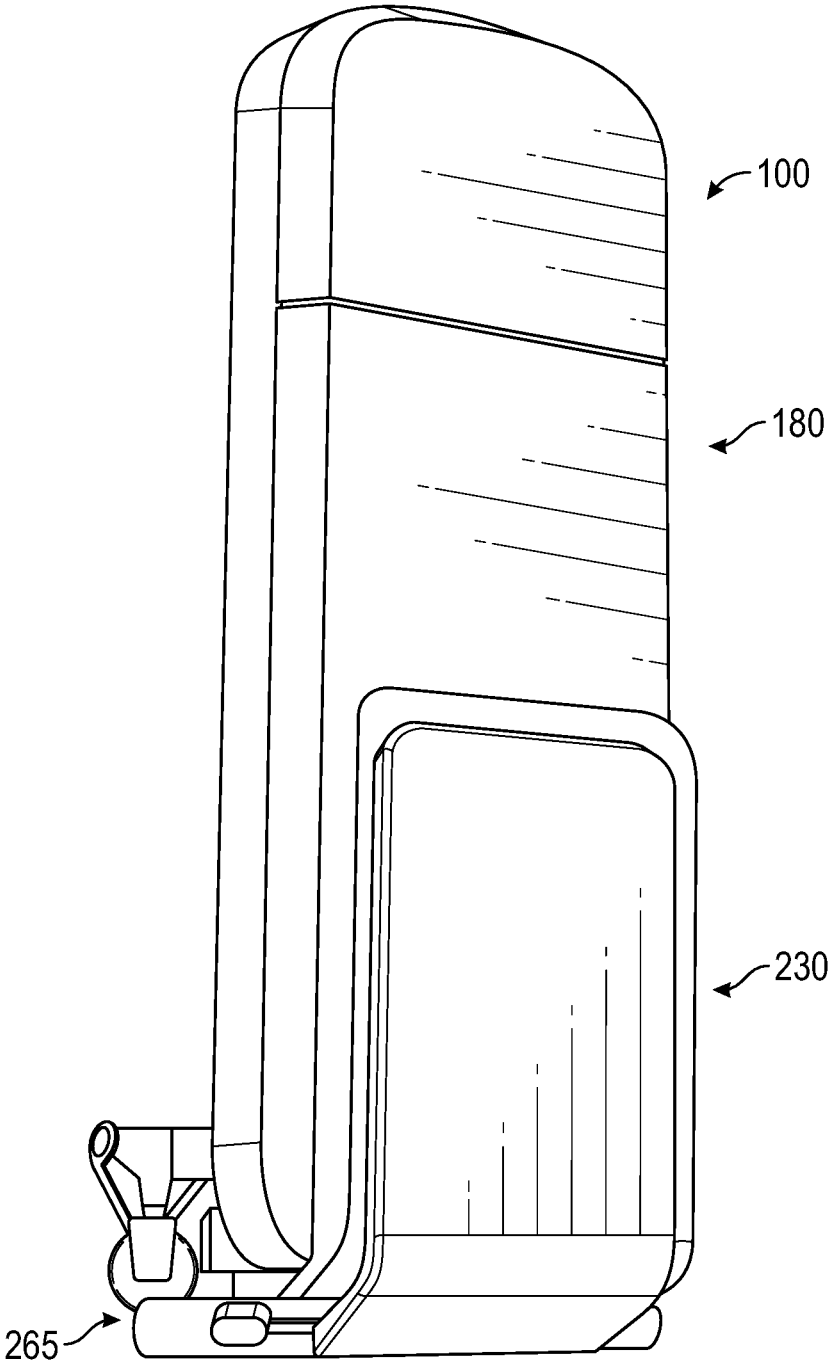
FIG. 5 is a perspective view of the inclinable exercise device of FIG. 1 shown in a folded configuration.

FIG. 5 is a perspective view of the inclinable exercise device 100 shown in a folded configuration or upright storage position. In this upright configuration, the inclinable exercise device 100 has an angled slanted stance to provide more stability. The inclinable exercise device 100 can also be stored in a flat configuration. The inclinable exercise device 100 preferably includes wheels integrated into the distal base 265 to facilitate transportation of the inclinable exercise device 100. The foot platform 230 folds up onto the user support platform 180.

Figure 6:
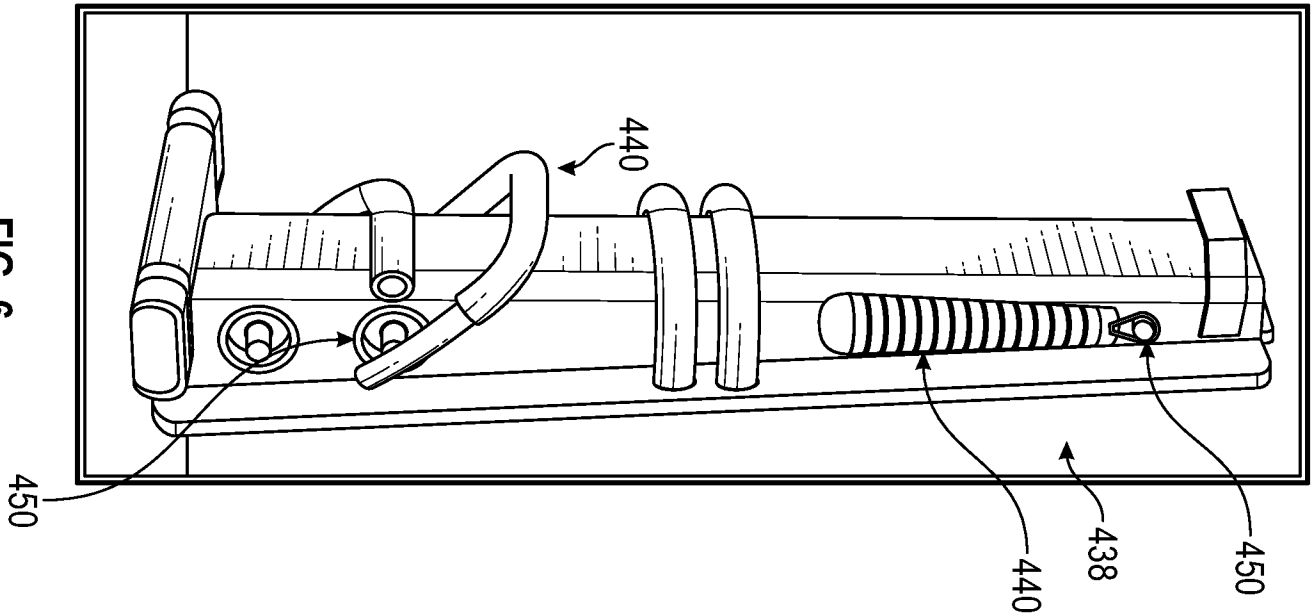
FIG. 6 is a rear perspective view of the tower of the inclinable exercise device of FIG. 1.

FIG. 6 is a rear perspective view of an embodiment of a tower 438, which may be similar to the tower 110 of the inclinable exercise device 100, and shows a number of exercise device accessories 440 that are removably attachable to the tower 438 via a variety of accessory attachment members 450. With reference additionally to FIG. 1, accessory attachment members 450 (e.g., leg pulley clips) may also be located on the angled tower plane or front cladding 262 of the tower 110.

Figure 8:
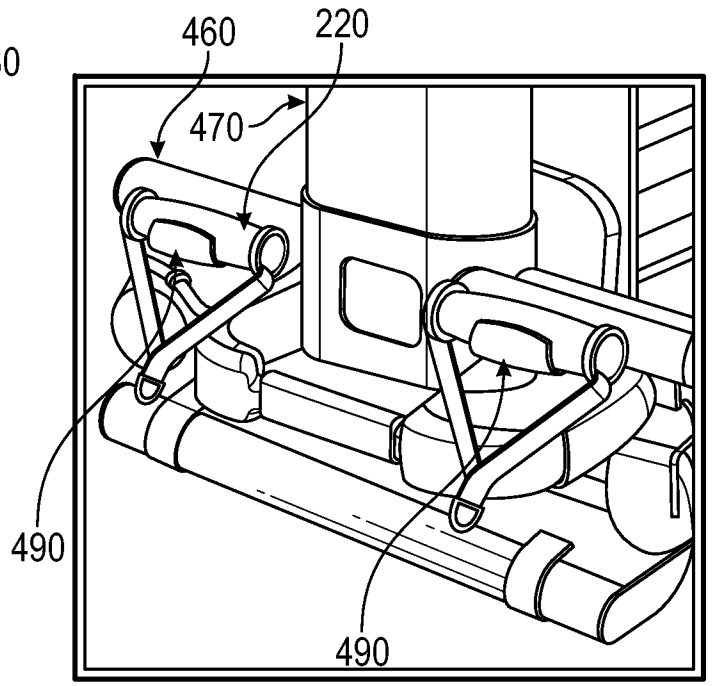
FIGS. 7 and 8 are rear perspective views of an embodiment of a carriage of a tower of an inclinable exercise device of FIG. 1.
Figure 7:
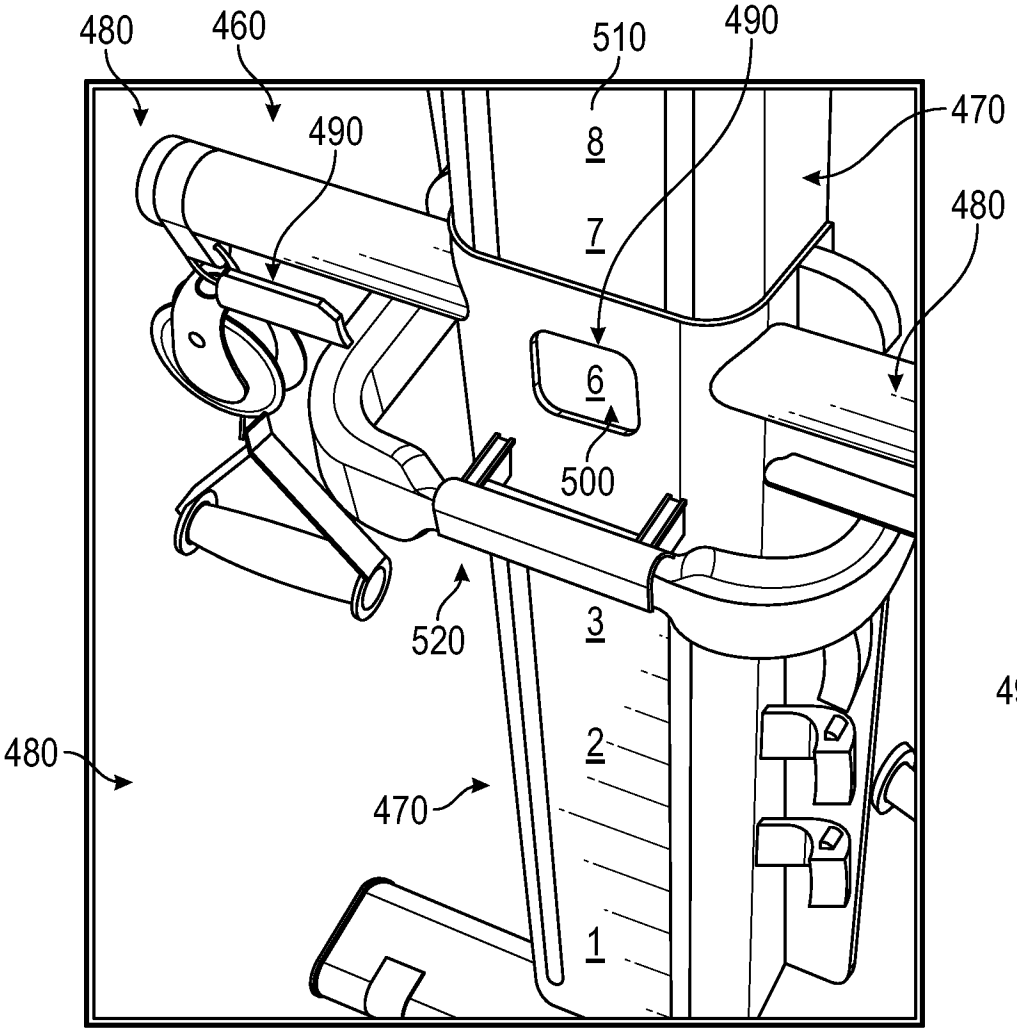

FIGS. 7 and 8 are rear perspective views of an embodiment of a carriage 460 of a tower 470 of an inclinable exercise device 480. The carriage 460, the tower 470, and the inclinable exercise device 480 are similar to the same elements described above, except that the carriage 460 includes a cutout window 490 that displays incline level 500 on a back 510 of the tower 470, the carriage 460 includes a pull trigger 520 that actuates a spring-loaded ratchet for setting the height of the carriage 460 relative to the tower 470, and the carriage 460 at opposite sides 480 includes handle docking stations/handle mounting supports 490 that the handles 220 are stored/docked/mounted to/within when not in use.

Figure 15:
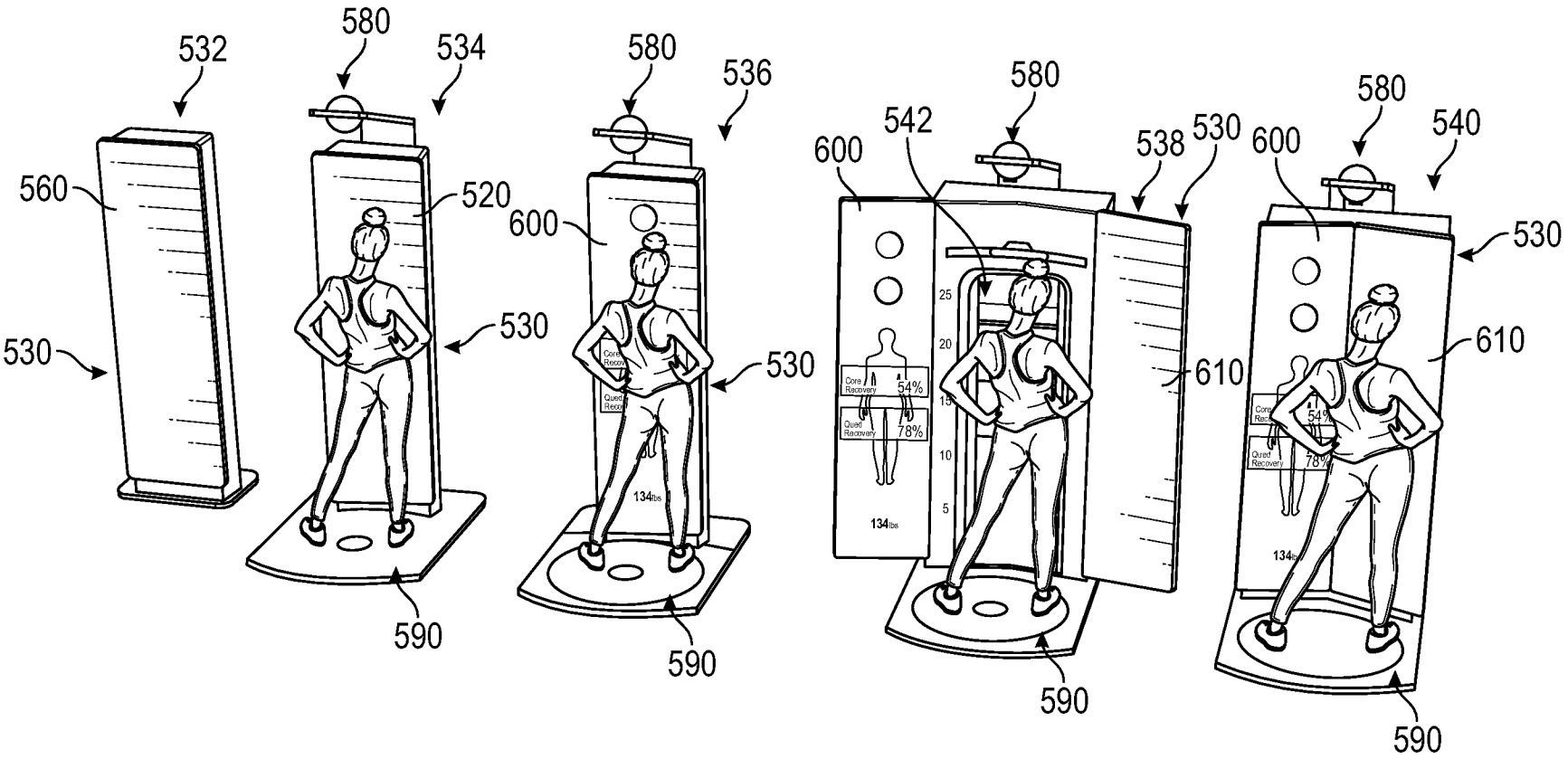
FIG. 15 illustrates perspective views of a number of different embodiments/versions of an inclinable exercise device system.

FIG. 15 illustrates a number of different embodiments/versions of an inclinable exercise device system 530. From left-to-right in FIG. 15 are shown a Mid-Tier model/version 532, a Premium model/version 534, a Premium Plus model/version 536, and Supreme models/versions 538, 540 of an inclinable exercise device system 530 including an inclinable exercise device 542 the same as or similar to the inclinable exercise device 100. For example, but not by way of limitation, each inclinable exercise device system 532, 534, 536, 538, 540 includes a cabinet 550 that encloses the inclinable exercise device 542, and the Mid-Tier model 532 further includes a fascia cover 560 and small monitor (e.g., IPad), the Premium model 534 further includes a projection surface/main fascia 570, 360 degree projector/high-def camera 580, smart weighing scale(s) 590, and small monitor (e.g., IPad), the Premium Plus model 536 further includes a high-definition monitor/main fascia 600, 360 degree projector/high-def camera 580, smart weighing scale(s) 590, and 3D body scan, and the Supreme models 538, 540 further includes a high-definition monitor/left or right fascia 600, 360 degree projector/high-def camera 580, smart weighing scale(s) 590, 3D body scan, right fascia projection screen 610, and full storage.

Figure 16:
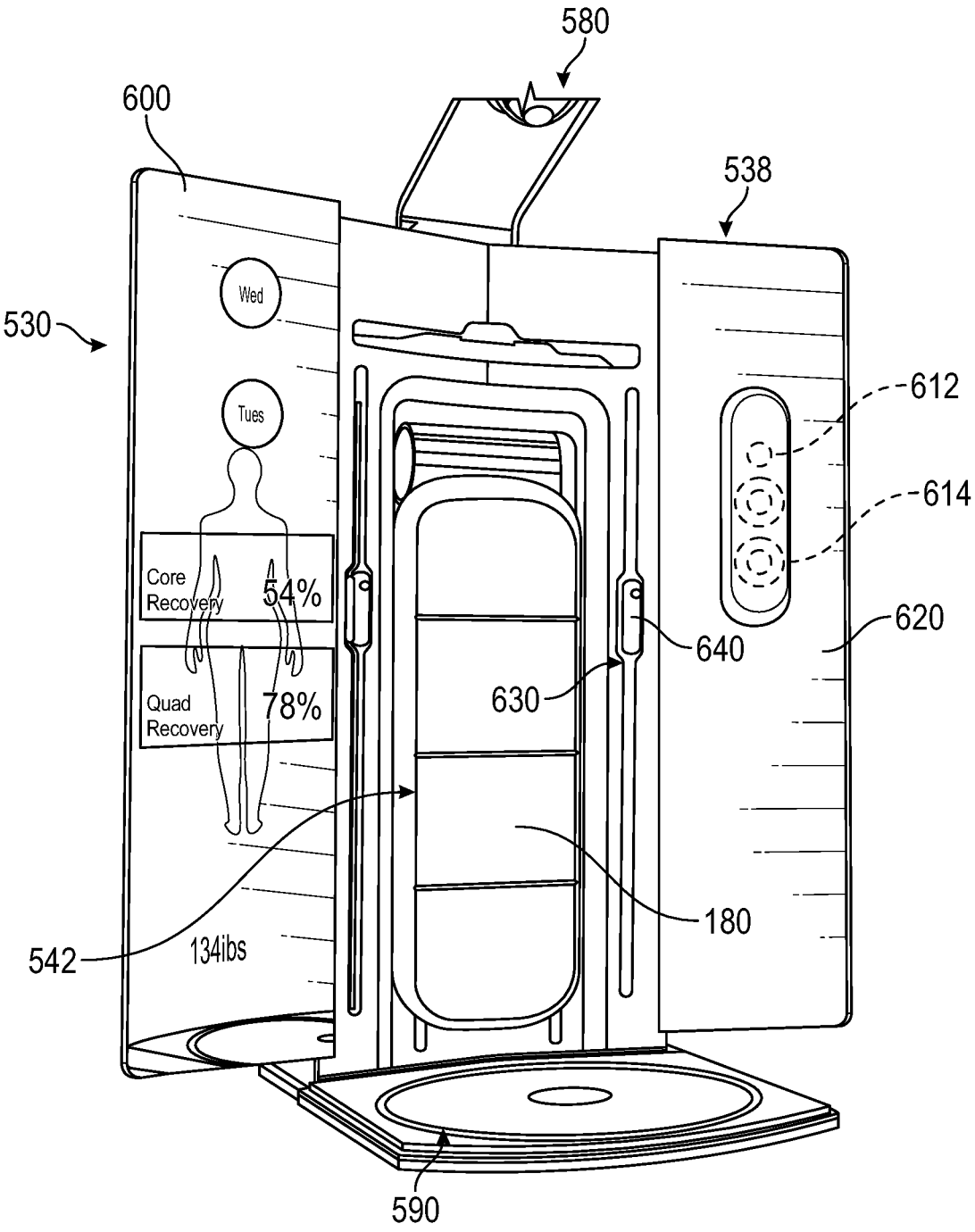
FIG. 16 is perspective view of a Supreme model/version of an inclinable exercise device system.

FIG. 16 illustrates the Supreme model/version 538 of an inclinable exercise device system 530. A microphone 612 and speaker(s) 614 are located behind static surface 620. The inclinable exercise device system 530 includes a main cabinet with magnetic receptacles 630 that magnetically receive/align handles 640 of inclinable exercise device 542. When in the magnetic receptacles 630, the handles 640 compress pogo pins for charging the handles 640. The user support platform 180 moves into (and is shown in) a "stored" position over charging contacts on the rail(s) when folded up/stored. One or more batteries powering one or more features of the handles 640, user support platform 180, and/or rails area charged when the user support platform 180 and rail(s) are in the stored position.

Figure 17:
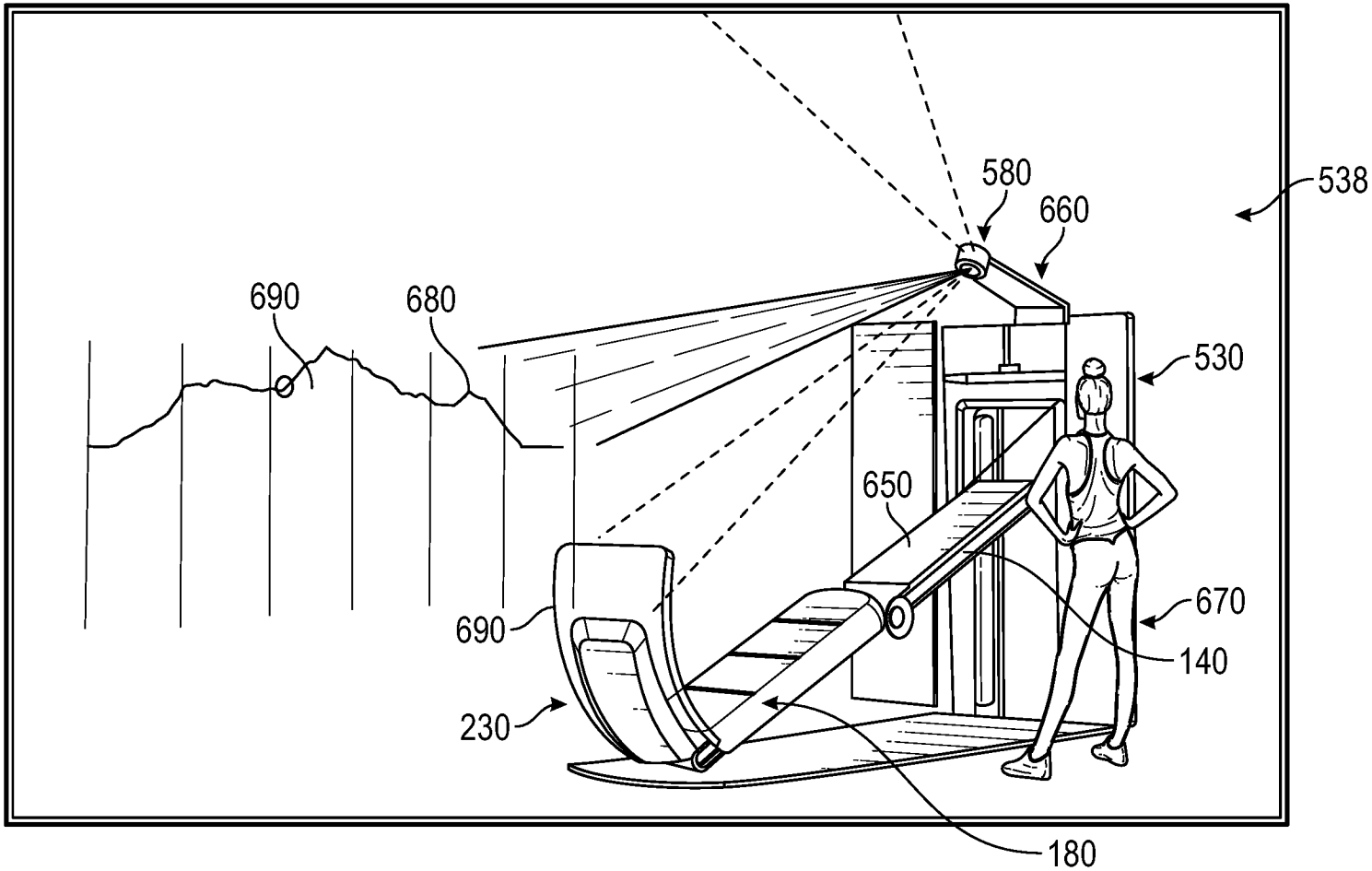
FIG. 17 is another perspective view of the Supreme model/version of the inclinable exercise device system, and illustrates an embodiment of a 360 degree projection system.

FIG. 17 illustrates the Supreme model/version 538 of the inclinable exercise device system 530 shown with the user support platform 180, the rails 140, a rail cover 650, the foot platform 230 shown in a deployed condition, and the 360 degree projector/high-def camera 580. The 360 degree projector 580 can project an image on any wall/ceiling/floor surface. The inclinable exercise device system 530 includes one or more sensors that are part of a detection system 660 that detects the viewing orientation of a user 670 based on the exercise a user 675 is doing, and, based on this detected viewing orientation by the detection system 660, projects information on an ideal surface plane 680 of multiple possible surface planes/surfaces 690 to optimize the user's experience.

Figure 18A:
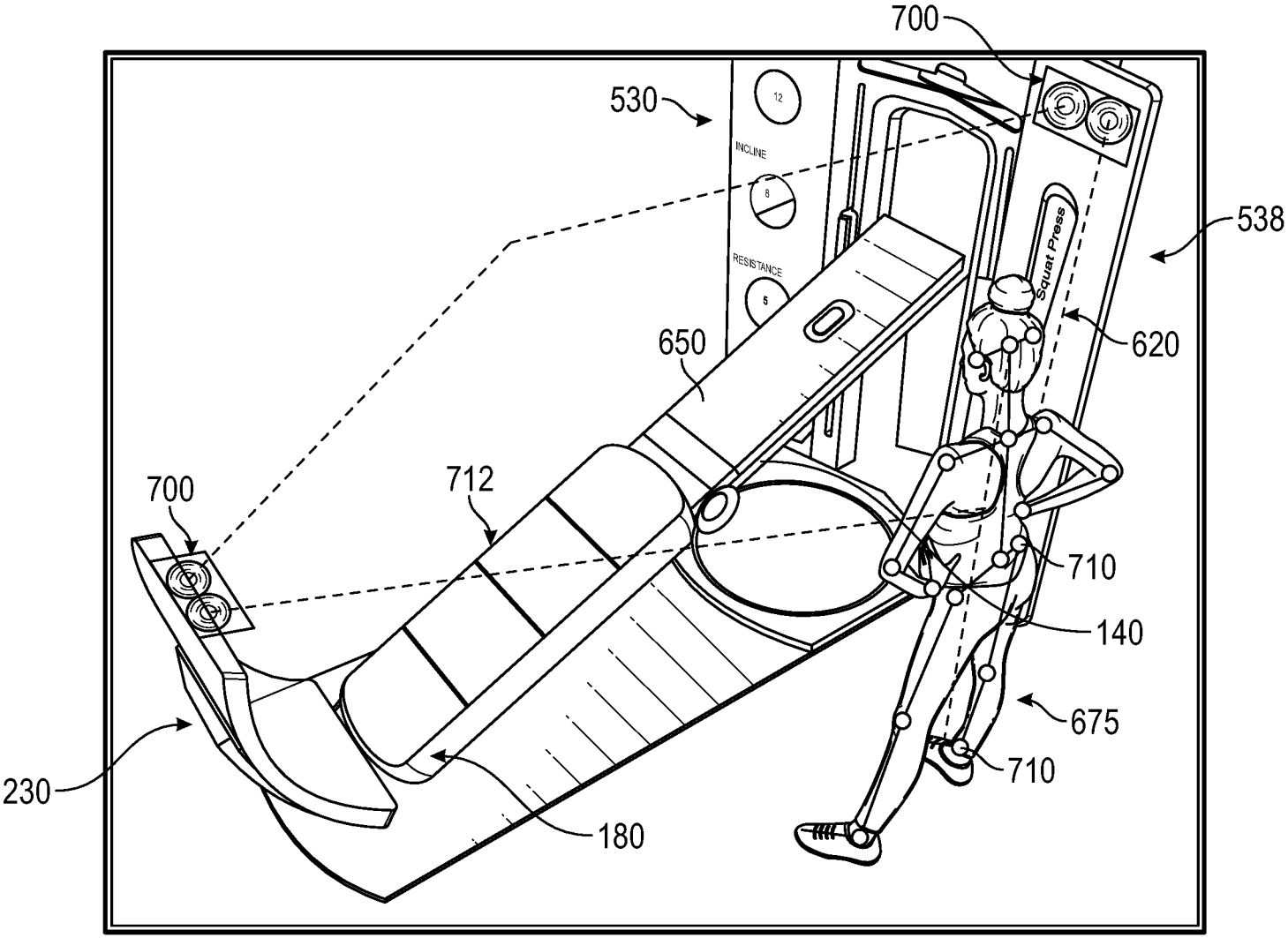
FIG. 18A is a further perspective view of the Supreme model/version of the inclinable exercise device system, and illustrates AI-driven skeletal tracking via depth camera(s)

FIG. 18A illustrates the Supreme model/version 538 of the inclinable exercise device system 530, and illustrates Artificial Intelligence (AI)-driven skeletal tracking via depth camera(s) 700. The camera(s) 700 may be, for example, but not by way of limitation, positioned at a top of the foot platform 230 and a top of the static surface 620. The camera(s) 700 may be one or more of Intel RealSense IR Camera(s), Intel RealSense LiDAR Camera(s), StereoLabs ZED 2 Color 3D Camera(s), and Mynt Eye Camera(s), the inclinable exercise device system 538 may include one or more of the following depth technologies: stereo scopic, RGP imaging, IR, and LiDAR, and one or more software modules that perform the AI-driven skeletal tracking include one or more of Open Pose, Dense Pose, and Cubemos Skeletal Tracking SDK. To perform the AI-driven skeletal tracking of the user 675, the user must be within camera field of view. The AI-driven skeletal tracking tracks 12-20 body points 710. The AI-driven skeletal tracking is performed by convolutional neural networks and may support gesture recognition.

Figure 18B:
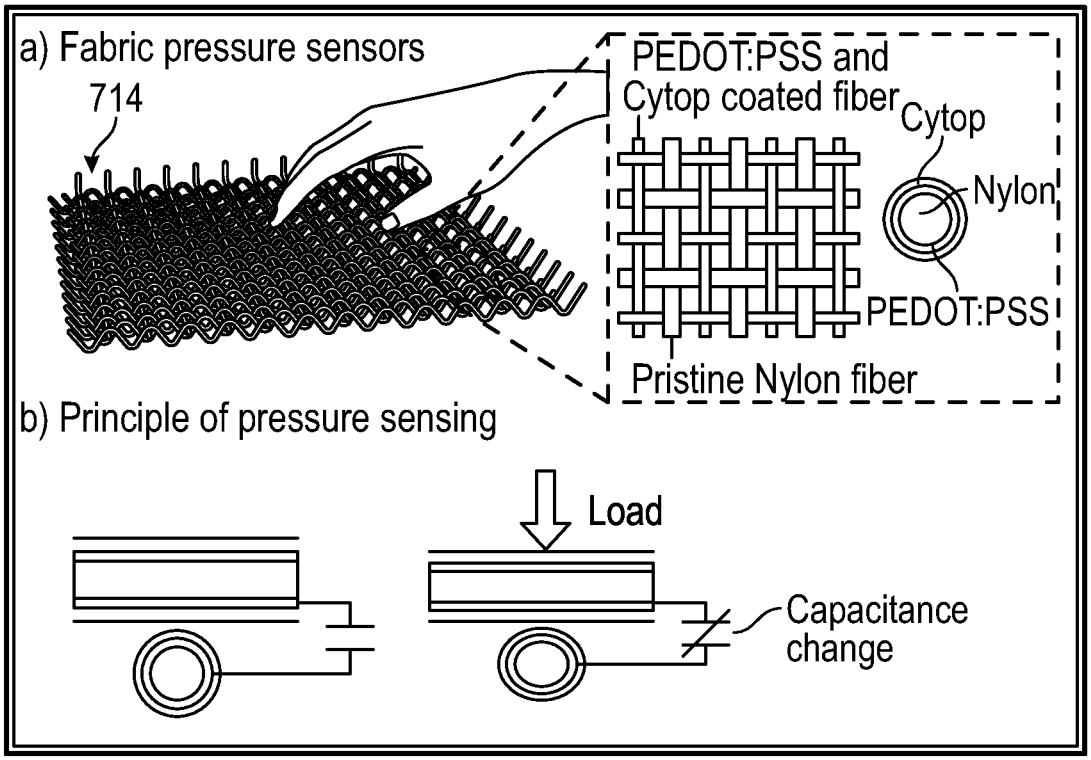
FIG. 18B illustrates pressure sensing technology that may be incorporated into the user support platform of the inclinable exercise device system.

FIG. 18B illustrates pressure sensing technology that may be incorporated into an integrated fabric pressure mapping system 712 (FIG. 18A) of the user support platform 180 of the inclinable exercise device system 530. The integrated fabric pressure mapping system 712 is used to determine and track posture of the user 675. As shown in a) of FIG. 18B, the integrated fabric pressure mapping system 712 may include fabric pressure sensors including PEDOT:PSS and cytop coated fiber and pristine nylon woven together into a top layer 714. As shown in b) of FIG. 18B, the principle of pressure sensing is shown where a measured/sensed capacitance change occurs in response to a load/pressure. The integrated fabric pressure mapping system 712 is woven into the top layer 714 with a more durable/cosmetic fabric cover above. Sensed pressure data is compared to known/predetermined data indicative of standard postures (e.g., sitting, laying, kneeling) to determine and track posture.

Figure 19:
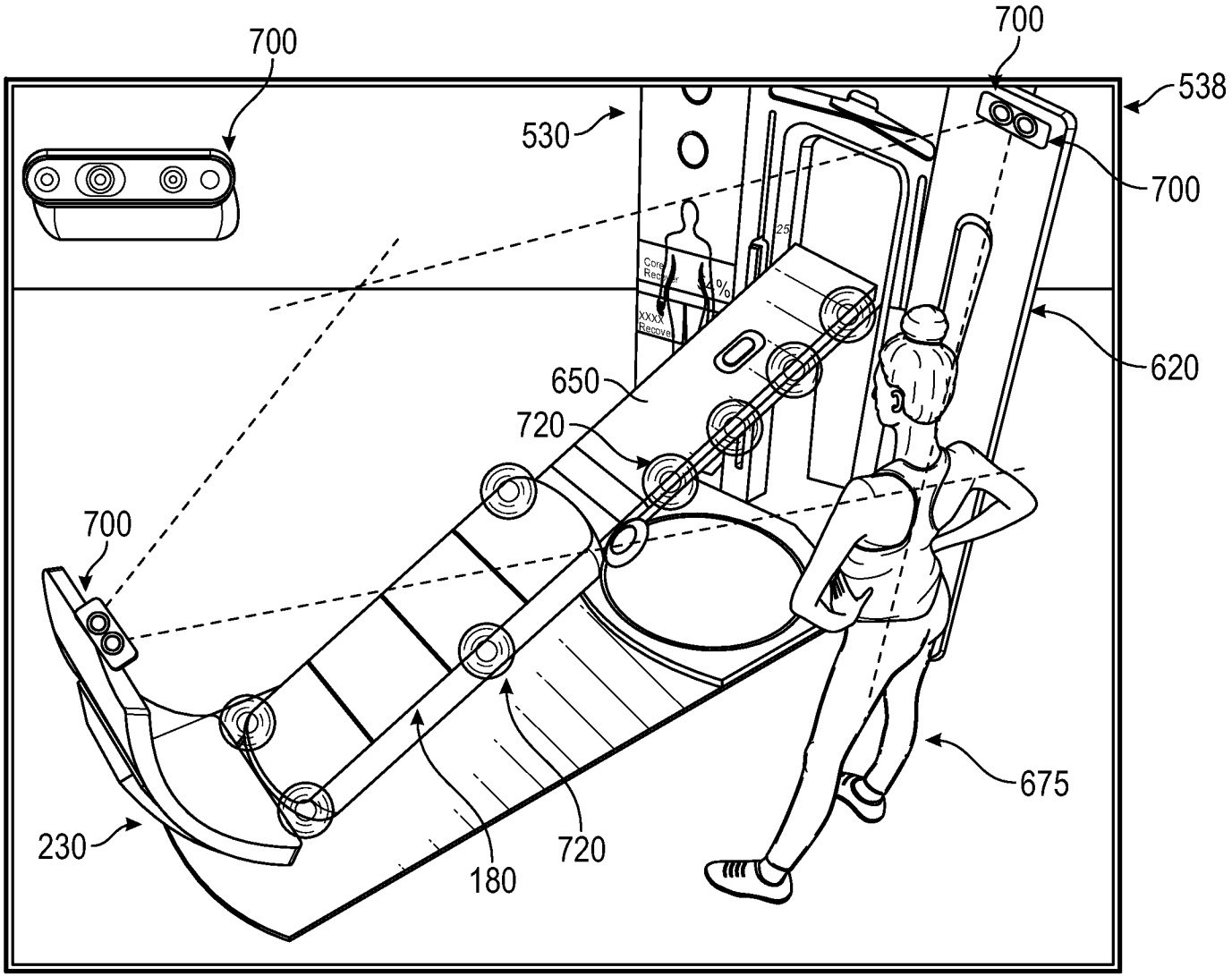
FIG. 19 is a still further perspective view of the Supreme model/version of the inclinable exercise device system, and illustrates video analysis of the user support platform and rails.

FIG. 19 illustrates the Supreme model/version 538 of the inclinable exercise device system 530, and illustrates video analysis of the user support platform 180 and rails 140 via IR LEDs 720 and the depth camera(s) 700. The IR LEDs 720 may be disposed on the rails 140. Since the inclinable exercise device system 530 is constrained to a simple rotational motion and known heights, the angle of the rails 140 can be calculated via video analysis. Similarly, the user support platform 180 may carry the IR LEDs 720. Since the inclinable exercise device system 530 is constrained to simple linear motion along the rails 140, position of the user support platform 180 can be derived observation by the depth camera(s) 700. Velocity and acceleration can be calculated via video analysis by measuring the distance traveled through sequential frames. The depth camera(s) 700 are preferably 2×IR cameras for constellation LED tracking. Each IR LED 720 pulses with a unique pattern to identify itself to the inclinable exercise device system 530.

Figure 20:
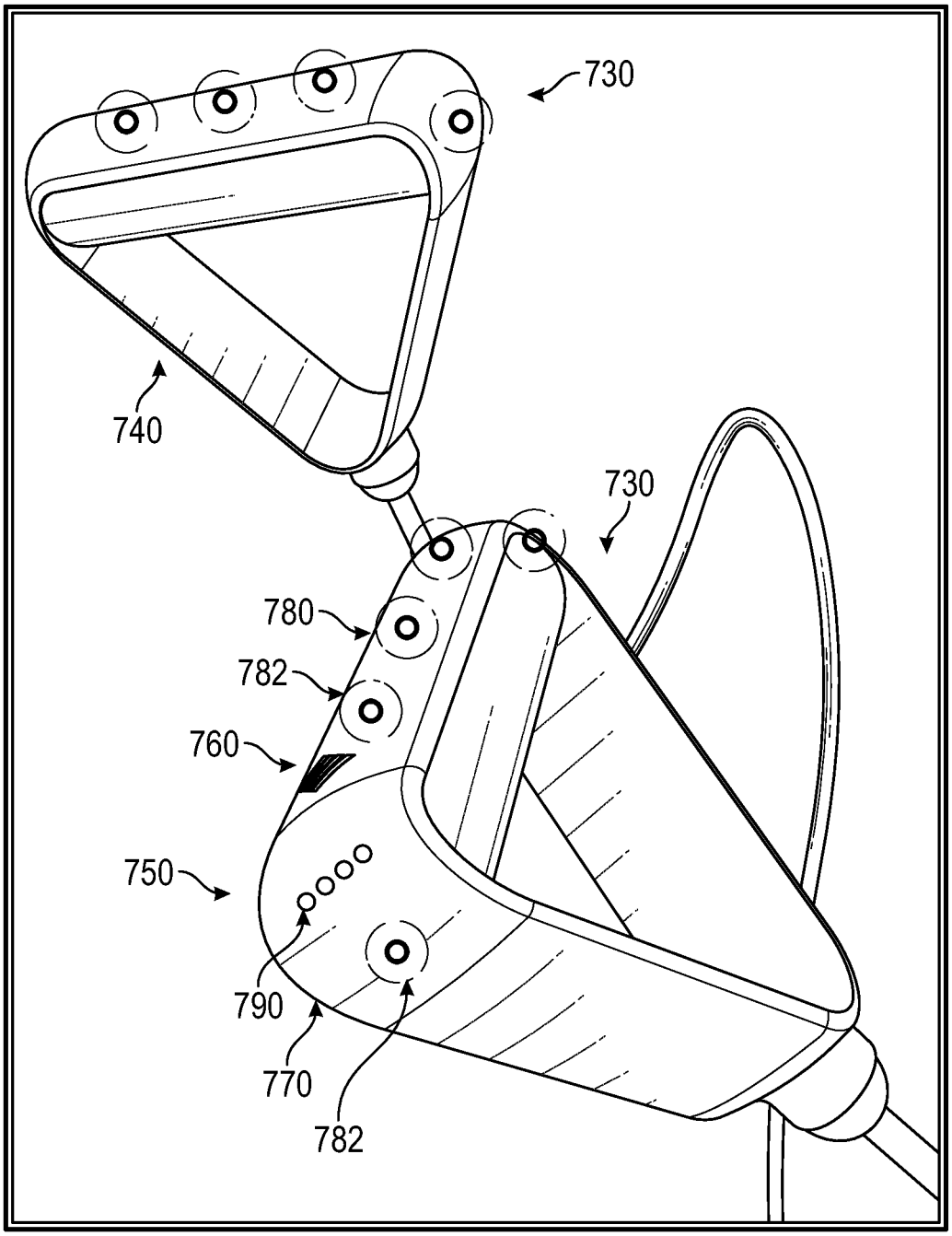
FIG. 20 is a perspective view of an embodiment of a pair of exercise device system handles.

FIG. 20 illustrates a pair of exercise device system handles 730 that may be used with any of the embodiments of inclinable exercise device systems shown and described herein (or with other exercise devices/systems). The handles 730 include a triangular frame 740 with a grip assembly 750. The grip assembly 750 includes grip 760, opposite end sections 770, and outer section 780. The opposite end sections 770 and outer section 780 include integrated infrared (IR) LEDs 782. One of the end sections 770 includes charging contacts 790. The grip assembly 750 also includes ECG electrodes, Inertial Measurement Unit sensors (IMUs), an onboard printed circuit board assembly (PCBA), and integrated electronics (e.g. Li-poly battery, BTE, power management) to provide a method of powering and controlling the components, managing the power, and streaming data (e.g., via Bluetooth, wireless communication device(s)) from the handle(s) 730 to the inclinable exercise device system.

Figure 21:
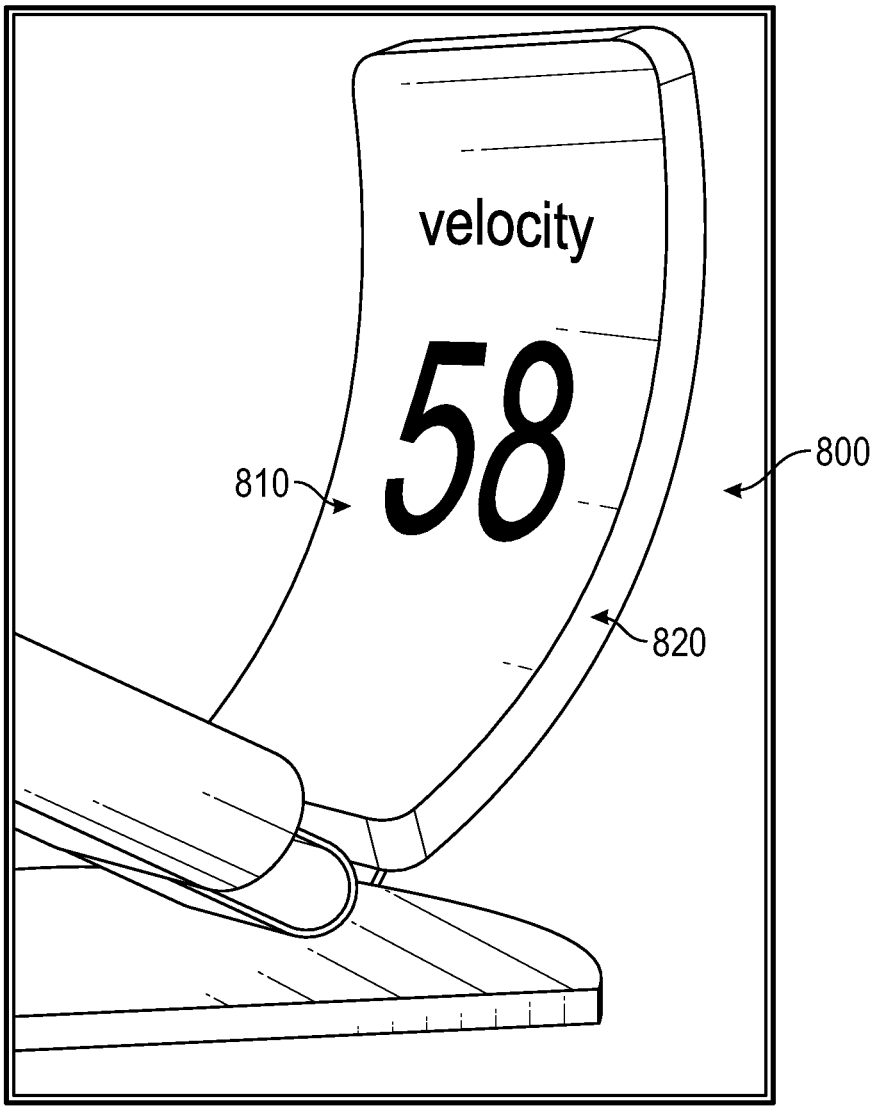
FIG. 21 is a perspective view of an embodiment of a foot platform of the inclinable exercise device system.

FIG. 21 illustrates an embodiment of a foot platform 800 of the inclinable exercise device system where the foot platform 800 includes a display 810 incorporated into an upper section/surface 820 of the foot platform 800. The display 810 may be one or more of a transparent flexible organic light-emitting diode (OLED) display, head-up display (HUD) using polycarbonate backed with clear front (or rear) projection film (e.g., for use with an embedded projector, folding mirrors).

Figure 22:
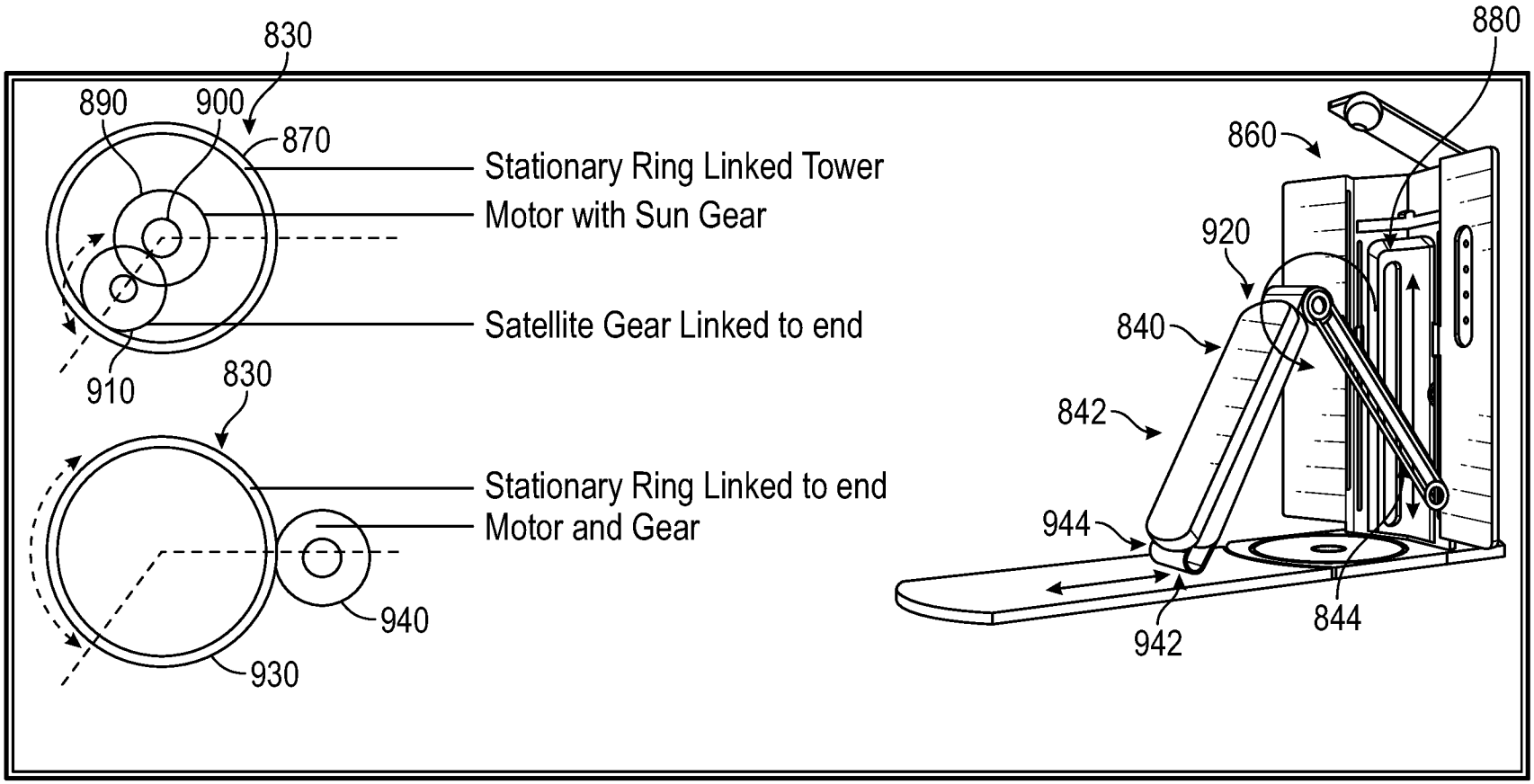
FIG. 22 is a perspective view of an inclinable exercise device system, and illustrates embodiments of a deployment and retraction mechanism of a support structure for a user support platform.

FIG. 22 illustrates embodiments of a deployment and retraction mechanism 830 of a support structure 840 (e.g., distal support structure 842, proximal support structure 844 rotatably coupled together via deployment and retraction mechanism 830) for a user support platform 850 that unfolds/deploys and folds/retracts the support structure 840 with respect to a cabinet 860. The deployment and retraction mechanism 830 may include a stationary ring gear 870 linked to tower 880, a motor 890 with a sun gear 900, and a satellite gear 910 linked to an end 920 or a stationary ring gear 930 linked to the end 920 and a motor and gear 940. A passive bearing/roller 942 at end 944 of the distal support structure 842 reduces drag and allows low friction movement of the end 944 along a surface. Rotation of the motor 890, 940 clockwise and counter clockwise causes the deployment and retraction mechanism 830 to function as a motorized joint to fold/unfold the support structure 840 with respect to the cabinet 860 and tower 880. The tower 880 includes a motorized lift to control elevation of the tower 880 via rack and pinion, guide rail, and an electric motor.

Figure 23:
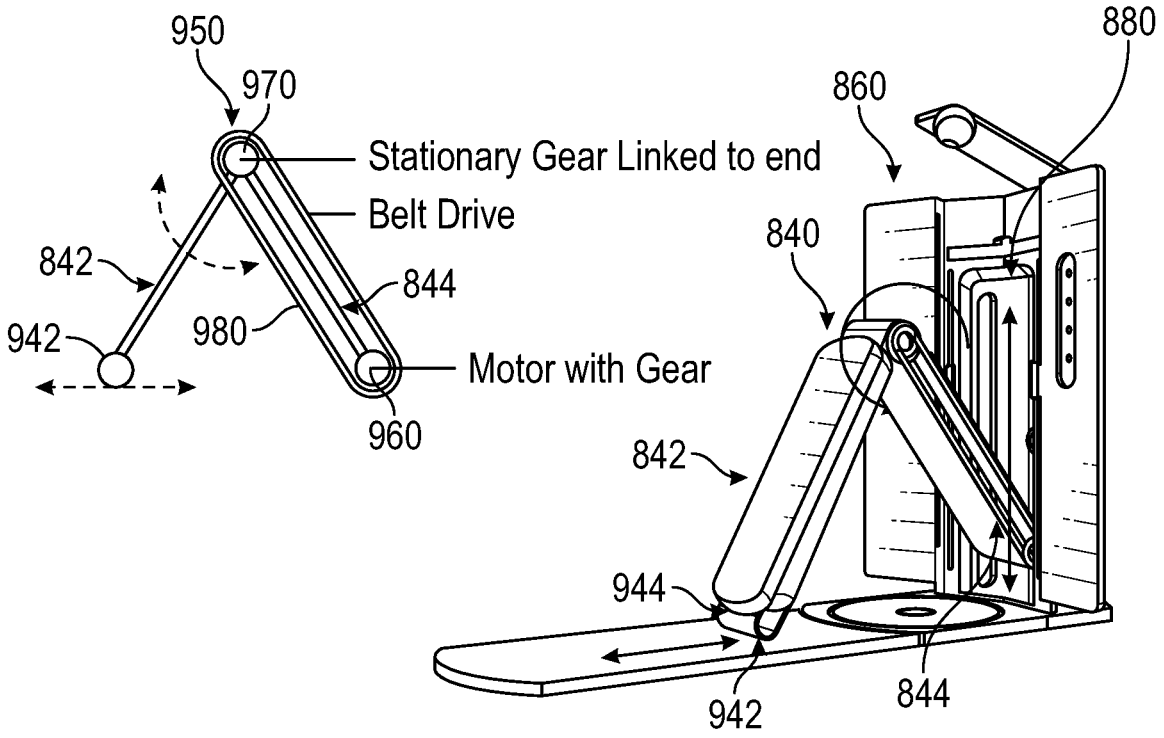
FIG. 23 is a perspective view of an inclinable exercise device system, and illustrates an alternative embodiment of a deployment and retraction mechanism of a support structure for a user support platform.

FIG. 23 illustrates an alternative embodiment of a deployment and retraction mechanism 950 of the support structure 840. The deployment and retraction mechanism 950 includes a motor with gear 960, a stationary gear 970 linked to the end 920, and a belt drive or cable drive 980 rotatably coupling the motor with gear 960 to the stationary gear 970. Rotation of the motor 960 clockwise and counter clockwise causes the belt drive or cable drive 980 to impart corresponding rotation to the stationary gear 970 (linked to the end 920) to fold/unfold the support structure 840 with respect to the cabinet 860 and tower 880. As mentioned above, the passive bearing/roller 942 reduces drag and allows low friction movement of the end 944 along the surface and the tower 880 includes the aforementioned motorized lift to control elevation of the tower 880.

Figure 24:
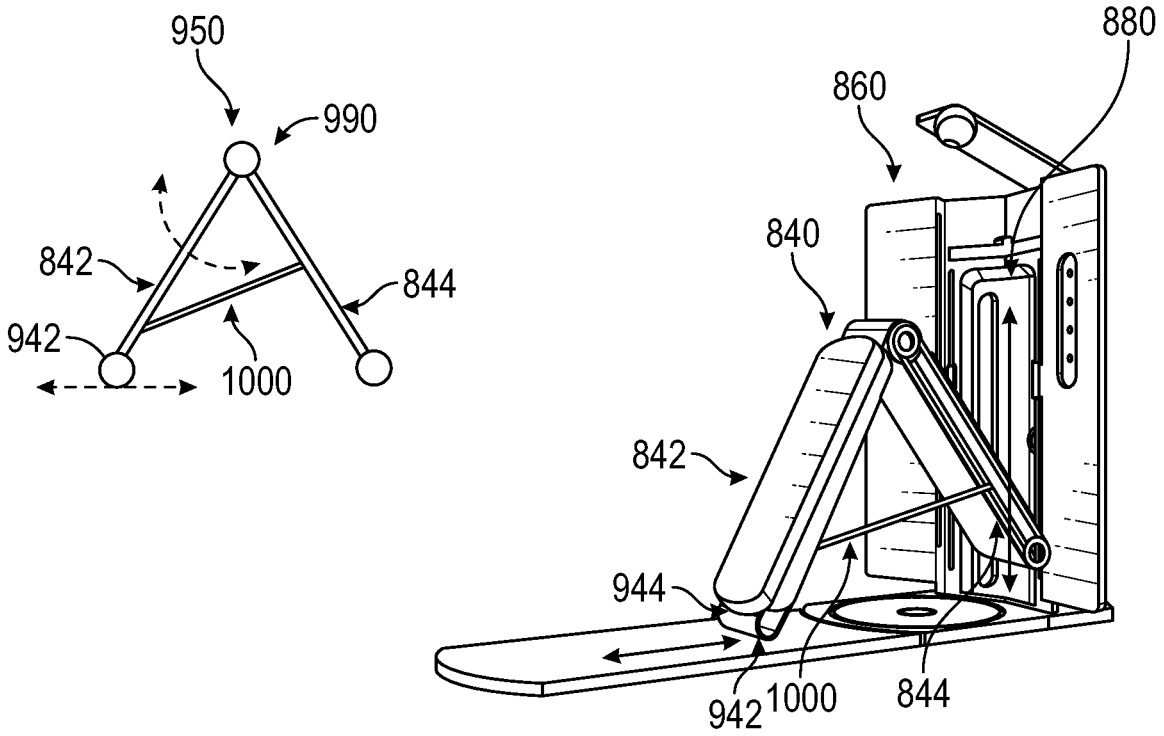
FIG. 24 is a perspective view of an inclinable exercise device system, and illustrates a further embodiment of a deployment and retraction mechanism of a support structure for a user support platform.

FIG. 24 illustrates a further embodiment of a deployment and retraction mechanism 990 of the support structure 840. The deployment and retraction mechanism 990 includes a movable strut (e.g., pneumatic strut/cylinder, hydraulic strut/cylinder) 1000 that moves to fold/unfold the support structure 840 with respect to the cabinet 860 and tower 880. As mentioned above, the passive bearing/roller 942 reduces drag and allows low friction movement of the end 944 along the surface and the tower 880 includes the aforementioned motorized lift to control elevation of the tower 880.

Figure 25:
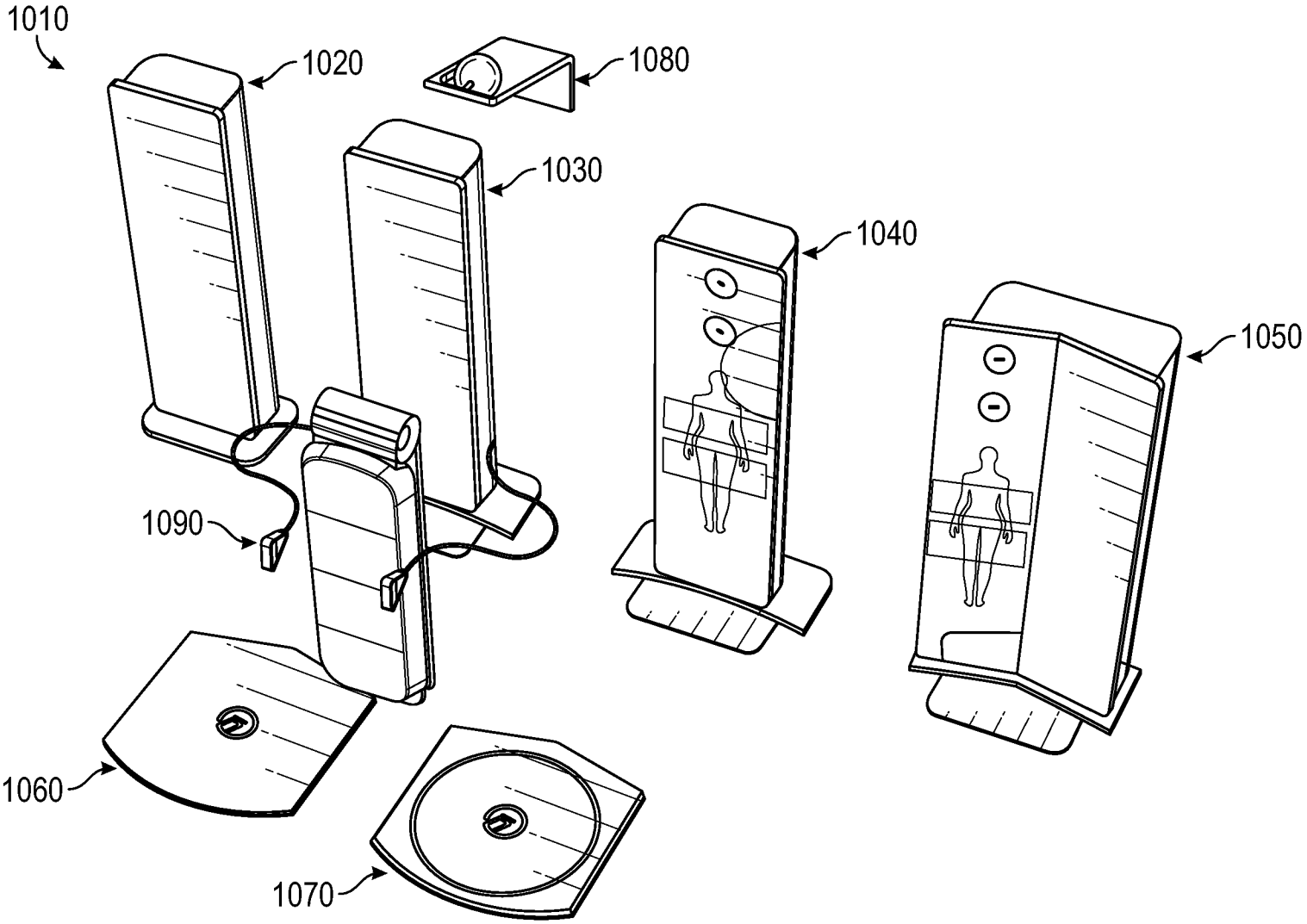
FIG. 25 illustrates perspective views of a number of different embodiments/versions of an inclinable exercise device system where one can select a different system foot print and tech package, a different base, and different accessories for a given/same fundamental inclined bench hub.

FIG. 25 illustrates a number of different embodiments/versions of an inclinable exercise device system 1010 where one can select different system foot print and tech packages 1020, 1030, 1040, 1050, different bases 1060, 1070, and different accessories 1080 with all options/embodiments/versions having the same fundamental inclined bench hub 1090 so one can create their own personalized, unique inclinable exercise device system 1010.

Figure 26:
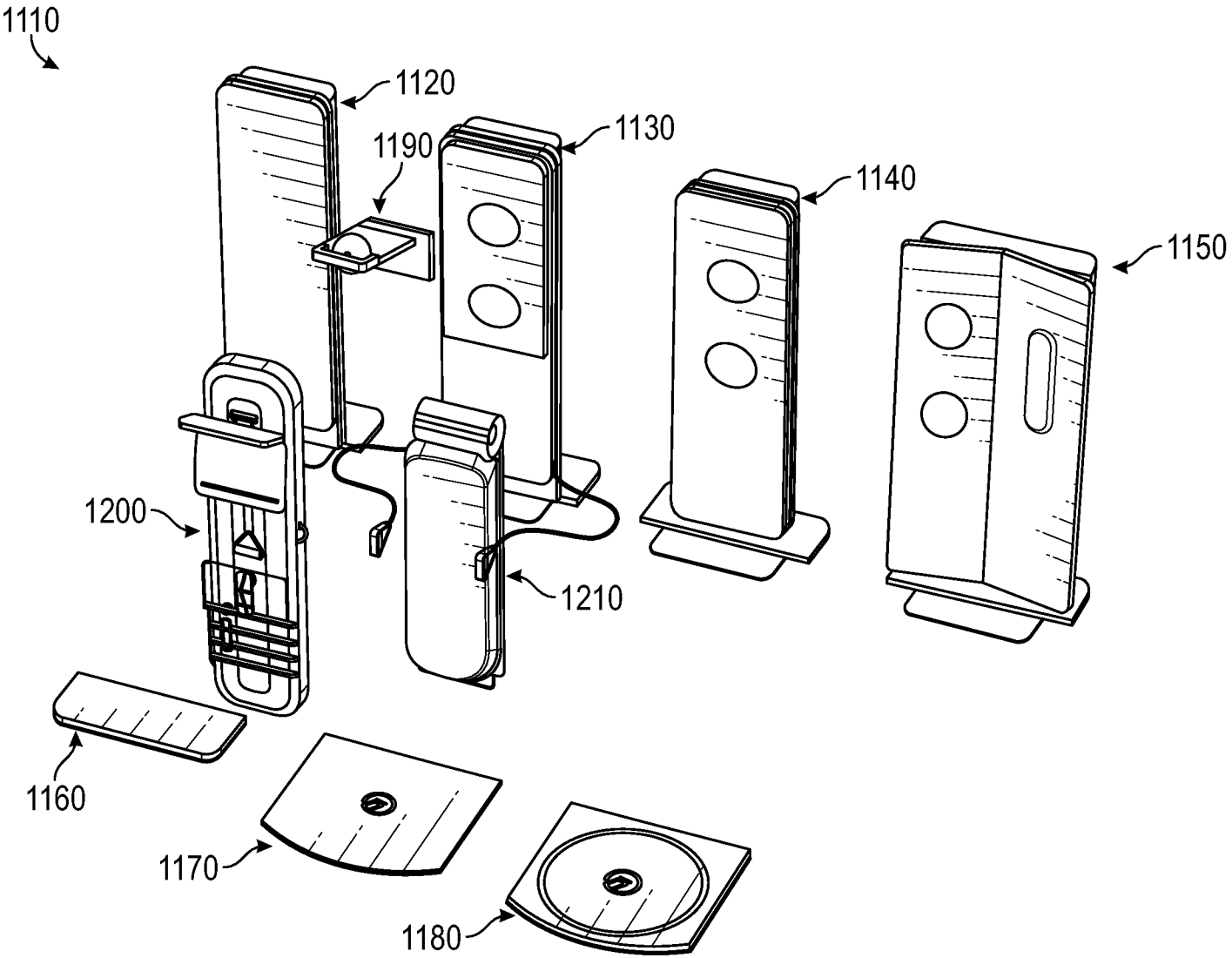
FIG. 26 illustrates perspective views of a number of different embodiments/versions of an inclinable exercise device system where one can select a different system foot print and tech package, a different base, different exercise equipment, and different accessories to customize one's inclinable exercise device system.

FIG. 26 illustrates a number of different embodiments/versions of an inclinable exercise device system 1110 where one can select different system foot print and tech packages 1120, 1130, 1140, 1150, different bases 1160, 1170, 1180, different accessories 1190, and different workout equipment 1200, 1210 so one can create their own personalized, unique inclinable exercise device system 1110. This platform architecture strategy enables great efficiencies and customization potential, leverages the same monitors across family of products, and leverages same system footprint and tech packages across products.

Figure 27:
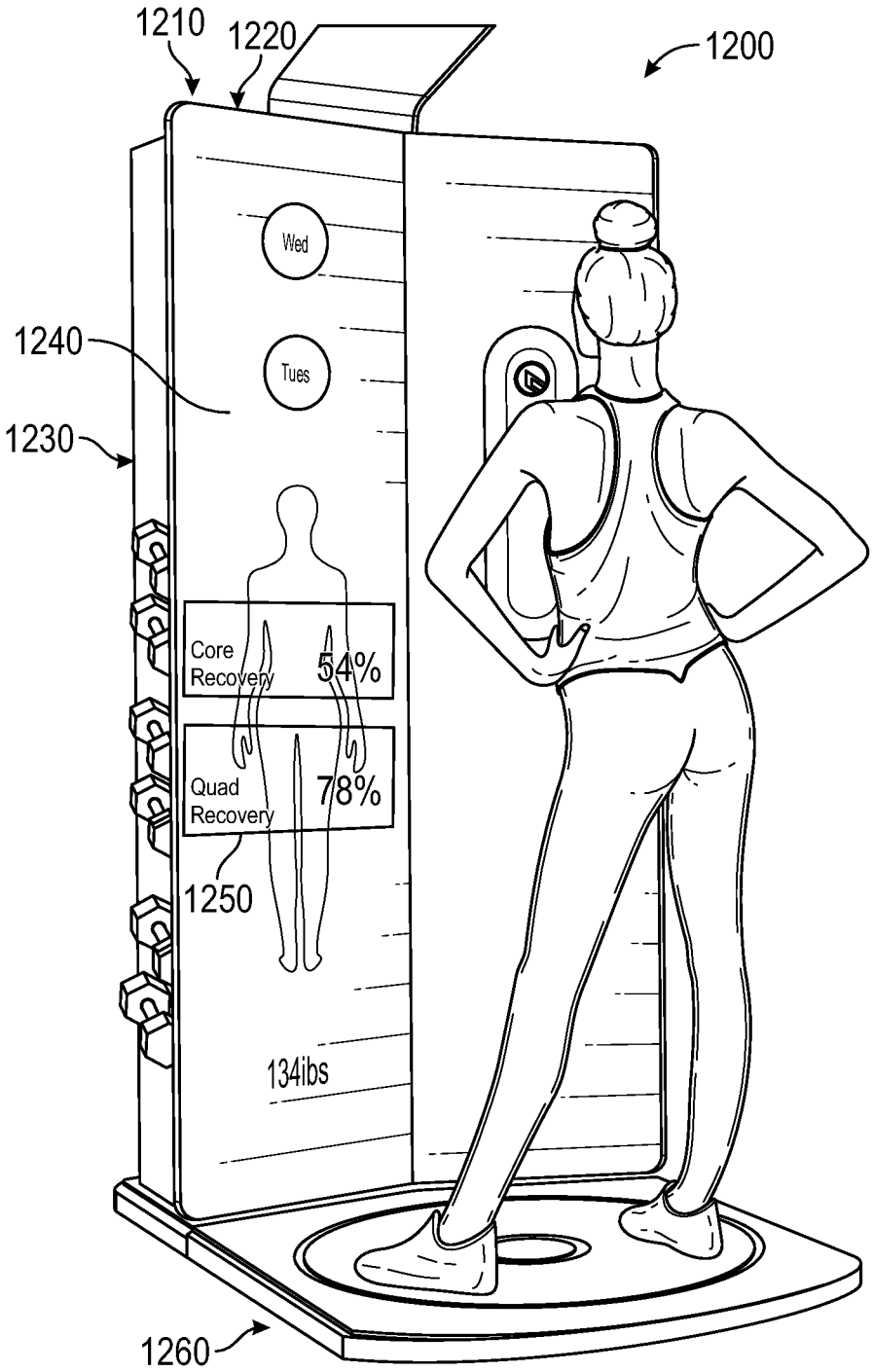
FIG. 27 illustrates a perspective view of another embodiment of an inclinable exercise device system.

FIG. 27 illustrates another embodiment of an inclinable exercise device system 1200. The inclinable exercise device system 1200 includes a modular system add-on 1210 that combines a high-tech display 1220 and accessory storage 1230, providing a full wellness solution. The high-tech display 1220 includes a screen 1240 that matches the finish of the system 1200 in an idol mode. The screen 1240 conceals underlying technology while still emphasizing vitals. Informative data 1250 based on AI is provided to help lead the user to good decisions. The inclinable exercise device system 1200 may also include a light-weight 3D body scan mat 1260.

In one or more embodiments, systems, methods, and non-transitory computer-readable media are utilized for any of the functions, processes, methods, and/or other processing devices shown and/or described herein with respect to the inclinable exercise device system(s).

1. System Overview 1.1. Infrastructure

Figure 28:
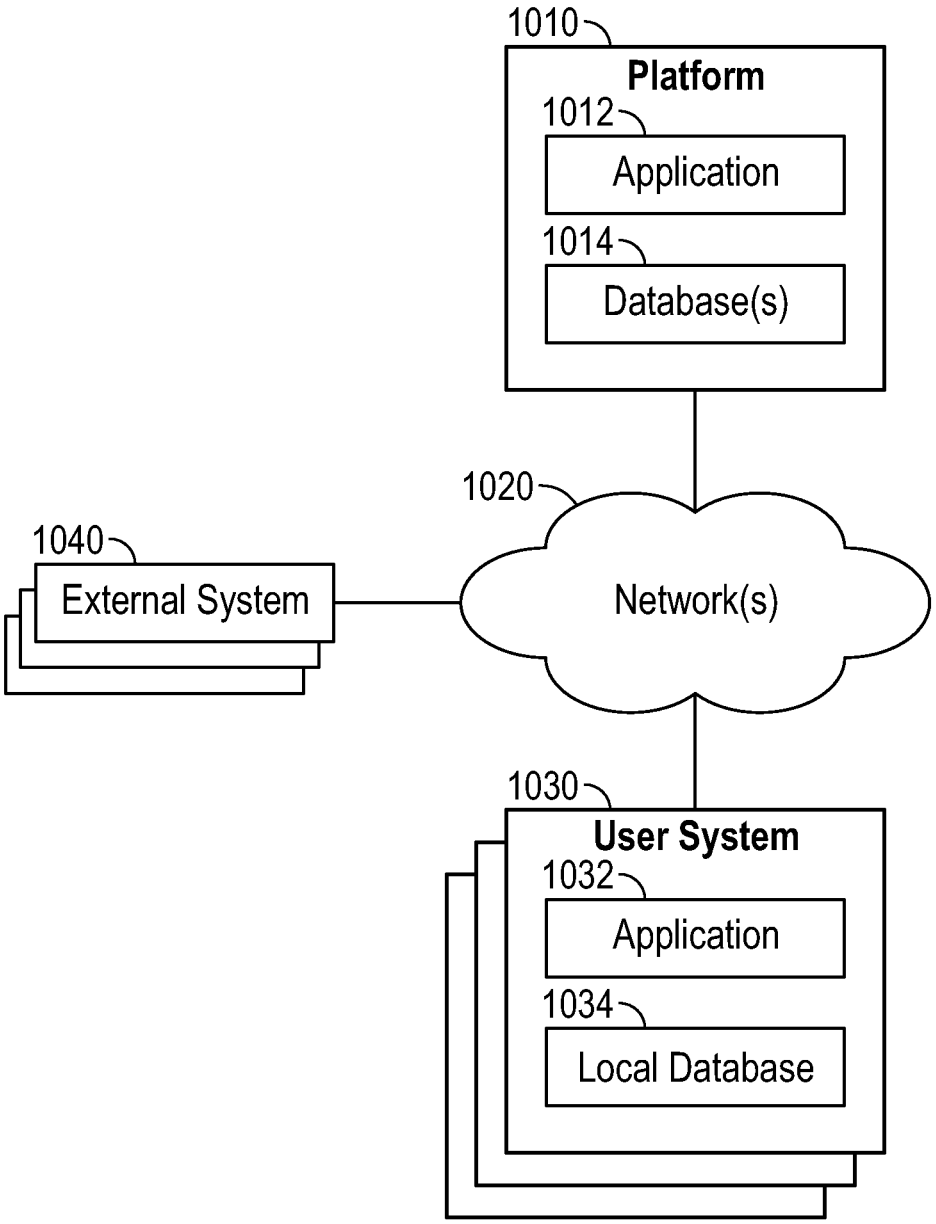
FIG. 28 illustrates an example infrastructure, in which one or more of the processes described herein, may be implemented, according to an embodiment.
Figure 29:
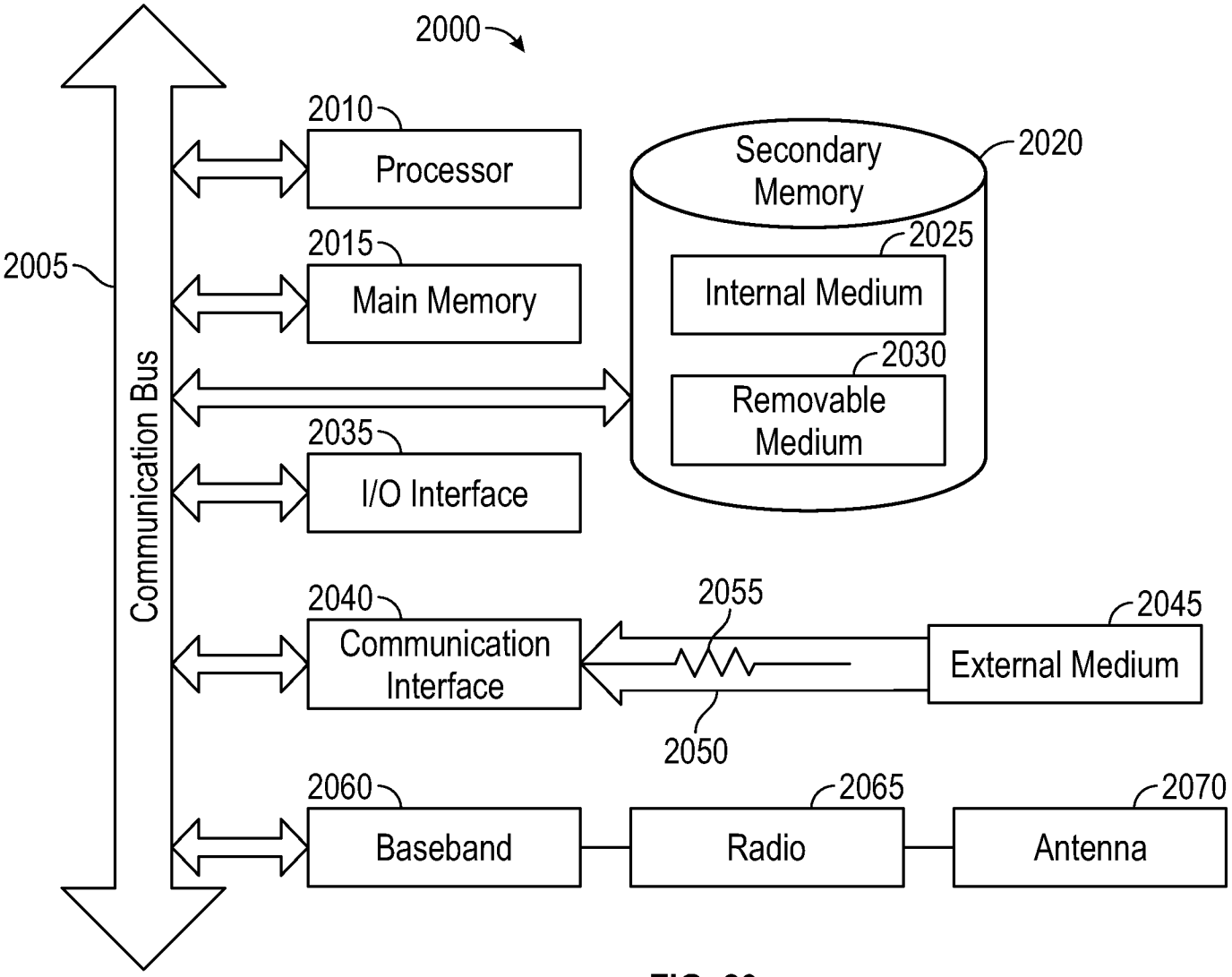
FIG. 29 illustrates an example processing system, by which one or more of the processes described herein, may be executed, according to an embodiment.

FIG. 28 illustrates an example infrastructure in which one or more of the disclosed processes may be implemented, according to an embodiment. The infrastructure may comprise a platform 1010 (e.g., one or more servers) which hosts and/or executes one or more of the various functions, processes, methods, and/or software modules described herein. Platform 1010 may comprise dedicated servers, or may instead comprise cloud instances, which utilize shared resources of one or more servers. These servers or cloud instances may be collocated and/or geographically distributed. Platform 1010 may also comprise or be communicatively connected to a server application 1012 and/or one or more databases 1014. In addition, platform 1010 may be communicatively connected to one or more user systems 1030 via one or more networks 1020. Platform 1010 may also be communicatively connected to one or more external systems 1040 (e.g., other platforms, websites, etc.) via one or more networks 1020.

Network(s) 1020 may comprise the Internet, and platform 1010 may communicate with user system(s) 1030 through the Internet using standard transmission protocols, such as HyperText Transfer Protocol (HTTP), HTTP Secure (HTTPS), File Transfer Protocol (FTP), FTP Secure (FTPS), Secure Shell FTP (SFTP), and the like, as well as proprietary protocols. While platform 1010 is illustrated as being connected to various systems through a single set of network(s) 1020, it should be understood that platform 1010 may be connected to the various systems via different sets of one or more networks. For example, platform 1010 may be connected to a subset of user systems 1030 and/or external systems 1040 via the Internet, but may be connected to one or more other user systems 1030 and/or external systems 1040 via an intranet. Furthermore, while only a few user systems 1030 and external systems 1040, one server application 1012, and one set of database(s) 1014 are illustrated, it should be understood that the infrastructure may comprise any number of user systems, external systems, server applications, and databases.

User system(s) 1030 may comprise any type or types of computing devices capable of wired and/or wireless communication, including without limitation, desktop computers, laptop computers, tablet computers, smart phones or other mobile phones, servers, game consoles, televisions, set-top boxes, electronic kiosks, point-of-sale terminals, and/or the like.

Platform 1010 may comprise web servers which host one or more websites and/or web services. In embodiments in which a website is provided, the website may comprise a graphical user interface, including, for example, one or more screens (e.g., webpages) generated in HyperText Markup Language (HTML) or other language. Platform 1010 transmits or serves one or more screens of the graphical user interface in response to requests from user system(s) 1030. In some embodiments, these screens may be served in the form of a wizard, in which case two or more screens may be served in a sequential manner, and one or more of the sequential screens may depend on an interaction of the user or user system 1030 with one or more preceding screens. The requests to platform 1010 and the responses from platform 1010, including the screens of the graphical user interface, may both be communicated through network(s) 1020, which may include the Internet, using standard communication protocols (e.g., HTTP, HTTPS, etc.). These screens (e.g., webpages) may comprise a combination of content and elements, such as text, images, videos, animations, references (e.g., hyperlinks), frames, inputs (e.g., textboxes, text areas, checkboxes, radio buttons, drop-down menus, buttons, forms, etc.), scripts (e.g., JavaScript), and the like, including elements comprising or derived from data stored in one or more databases (e.g., database(s) 1014) that are locally and/or remotely accessible to platform 1010. Platform 1010 may also respond to other requests from user system(s) 1030.

Platform 1010 may further comprise, be communicatively coupled with, or otherwise have access to one or more database(s) 1014. For example, platform 1010 may comprise one or more database servers which manage one or more databases 1014. A user system 1030 or server application 1012 executing on platform 1010 may submit data (e.g., user data, form data, etc.) to be stored in database(s) 1014, and/or request access to data stored in database(s) 1014. Any suitable database may be utilized, including without limitation MySQL™, Oracle™, IBM™, Microsoft SQL™, Access™, PostgreSQL™, and the like, including cloud-based databases and proprietary databases. Data may be sent to platform 1010, for instance, using the well-known POST request supported by HTTP, via FTP, and/or the like. This data, as well as other requests, may be handled, for example, by server-side web technology, such as a servlet or other software module (e.g., comprised in server application 1012), executed by platform 1010.

In embodiments in which a web service is provided, platform 1010 may receive requests from external system(s) 1040, and provide responses in eXtensible Markup Language (XML), JavaScript Object Notation (JSON), and/or any other suitable or desired format. In such embodiments, platform 1010 may provide an application programming interface (API) which defines the manner in which user system(s) 1030 and/or external system(s) 1040 may interact with the web service. Thus, user system(s) 1030 and/or external system(s) 1040 (which may themselves be servers), can define their own user interfaces, and rely on the web service to implement or otherwise provide the backend processes, methods, functionality, storage, and/or the like, described herein. For example, in such an embodiment, a client application 1032, executing on one or more user system(s) 1030 and potentially using a local database 1034, may interact with a server application 1012 executing on platform 1010 to execute one or more or a portion of one or more of the various functions, processes, methods, and/or software modules described herein. In an embodiment, client application 1032 may utilize a local database 1034 for storing data locally on user system 1030. Client application 1032 may be "thin," in which case processing is primarily carried out server-side by server application 1012 on platform 1010. A basic example of a thin client application 1032 is a browser application, which simply requests, receives, and renders webpages at user system(s) 1030, while server application 1012 on platform 1010 is responsible for generating the webpages and managing database functions. Alternatively, the client application may be "thick," in which case processing is primarily carried out client-side by user system(s) 1030. It should be understood that client application 1032 may perform an amount of processing, relative to server application 1012 on platform 1010, at any point along this spectrum between "thin" and "thick," depending on the design goals of the particular implementation. In any case, the software described herein, which may wholly reside on either platform 1010 (e.g., in which case server application 1012 performs all processing) or user system(s) 1030 (e.g., in which case client application 1032 performs all processing) or be distributed between platform 1010 and user system(s) 1030 (e.g., in which case server application 1012 and client application 1032 both perform processing), can comprise one or more executable software modules comprising instructions that implement one or more of the processes, methods, or functions described herein.

1.2. Example Processing Device

FIG. 2 is a block diagram illustrating an example wired or wireless system 2000 that may be used in connection with various embodiments described herein. For example, system 2000 may be used as or in conjunction with one or more of the functions, processes, or methods (e.g., to store and/or execute the software) described herein, and may represent components of platform 1010, user system(s) 1030, external system(s) 1040, and/or other processing devices described herein. System 2000 can be a server or any conventional personal computer, or any other processor-enabled device that is capable of wired or wireless data communication. Other computer systems and/or architectures may be also used, as will be clear to those skilled in the art.

System 2000 preferably includes one or more processors 2010. Processor(s) 2010 may comprise a central processing unit (CPU). Additional processors may be provided, such as a graphics processing unit (GPU), an auxiliary processor to manage input/output, an auxiliary processor to perform floating-point mathematical operations, a special-purpose microprocessor having an architecture suitable for fast execution of signal-processing algorithms (e.g., digital-signal processor), a slave processor subordinate to the main processing system (e.g., back-end processor), an additional microprocessor or controller for dual or multiple processor systems, and/or a coprocessor. Such auxiliary processors may be discrete processors or may be integrated with processor 2010. Examples of processors which may be used with system 2000 include, without limitation, any of the processors (e.g., Pentium™, Core i7™, Xeon™, etc.) available from Intel Corporation of Santa Clara, California, any of the processors available from Advanced Micro Devices, Incorporated (AMD) of Santa Clara, California, any of the processors (e.g., A series, M series, etc.) available from Apple Inc. of Cupertino, any of the processors (e.g., Exynos™) available from Samsung Electronics Co., Ltd., of Seoul, South Korea, and/or the like.

Processor 2010 is preferably connected to a communication bus 2005. Communication bus 2005 may include a data channel for facilitating information transfer between storage and other peripheral components of system 2000. Furthermore, communication bus 2005 may provide a set of signals used for communication with processor 2010, including a data bus, address bus, and/or control bus (not shown). Communication bus 2005 may comprise any standard or non-standard bus architecture such as, for example, bus architectures compliant with industry standard architecture (ISA), extended industry standard architecture (EISA), Micro Channel Architecture (MCA), peripheral component interconnect (PCI) local bus, standards promulgated by the Institute of Electrical and Electronics Engineers (IEEE) including IEEE 488 general-purpose interface bus (GPIB), IEEE 696/S-100, and/or the like.

System 2000 preferably includes a main memory 2015 and may also include a secondary memory 2020. Main memory 2015 provides storage of instructions and data for programs executing on processor 2010, such as one or more of the functions and/or modules discussed herein. It should be understood that programs stored in the memory and executed by processor 2010 may be written and/or compiled according to any suitable language, including without limitation C/C++, Java, JavaScript, Perl, Visual Basic, .NET, and the like. Main memory 2015 is typically semiconductor-based memory such as dynamic random access memory (DRAM) and/or static random access memory (SRAM). Other semiconductor-based memory types include, for example, synchronous dynamic random access memory (SDRAM), Rambus dynamic random access memory (RDRAM), ferroelectric random access memory (FRAM), and the like, including read only memory (ROM).

Secondary memory 2020 may optionally include an internal medium 2025 and/or a removable medium 2030. Removable medium 2030 is read from and/or written to in any well-known manner. Removable storage medium 2030 may be, for example, a magnetic tape drive, a compact disc (CD) drive, a digital versatile disc (DVD) drive, other optical drive, a flash memory drive, and/or the like.

Secondary memory 2020 is a non-transitory computer-readable medium having computer-executable code (e.g., disclosed software modules) and/or other data stored thereon. The computer software or data stored on secondary memory 2020 is read into main memory 2015 for execution by processor 2010.

In alternative embodiments, secondary memory 2020 may include other similar means for allowing computer programs or other data or instructions to be loaded into system 2000. Such means may include, for example, a communication interface 2040, which allows software and data to be transferred from external storage medium 2045 to system 2000. Examples of external storage medium 2045 may include an external hard disk drive, an external optical drive, an external magneto-optical drive, and/or the like. Other examples of secondary memory 2020 may include semiconductor-based memory, such as programmable read-only memory (PROM), erasable programmable read-only memory (EPROM), electrically erasable read-only memory (EEPROM), and flash memory (block-oriented memory similar to EEPROM).

As mentioned above, system 2000 may include a communication interface 2040. Communication interface 2040 allows software and data to be transferred between system 2000 and external devices (e.g. printers), networks, or other information sources. For example, computer software or executable code may be transferred to system 2000 from a network server (e.g., platform 1010) via communication interface 2040. Examples of communication interface 2040 include a built-in network adapter, network interface card (NIC), Personal Computer Memory Card International Association (PCMCIA) network card, card bus network adapter, wireless network adapter, Universal Serial Bus (USB) network adapter, modem, a wireless data card, a communications port, an infrared interface, an IEEE 1394 fire-wire, and any other device capable of interfacing system 2000 with a network (e.g., network(s) 1020) or another computing device. Communication interface 2040 preferably implements industry-promulgated protocol standards, such as Ethernet IEEE 802 standards, Fiber Channel, digital subscriber line (DSL), asynchronous digital subscriber line (ADSL), frame relay, asynchronous transfer mode (ATM), integrated digital services network (ISDN), personal communications services (PCS), transmission control protocol/Internet protocol (TCP/IP), serial line Internet protocol/point to point protocol (SLIP/PPP), and so on, but may also implement customized or non-standard interface protocols as well.

Software and data transferred via communication interface 2040 are generally in the form of electrical communication signals 2055. These signals 2055 may be provided to communication interface 2040 via a communication channel 2050. In an embodiment, communication channel 2050 may be a wired or wireless network (e.g., network(s) 1020), or any variety of other communication links. Communication channel 2050 carries signals 2055 and can be implemented using a variety of wired or wireless communication means including wire or cable, fiber optics, conventional phone line, cellular phone link, wireless data communication link, radio frequency ("RF") link, or infrared link, just to name a few.

Computer-executable code (e.g., computer programs, such as the disclosed software) is stored in main memory 2015 and/or secondary memory 2020. Computer programs can also be received via communication interface 2040 and stored in main memory 2015 and/or secondary memory 2020. Such computer programs, when executed, enable system 2000 to perform the various functions of the disclosed embodiments as described elsewhere herein.

In this description, the term "computer-readable medium" is used to refer to any non-transitory computer-readable storage media used to provide computer-executable code and/or other data to or within system 2000. Examples of such media include main memory 2015, secondary memory 2020 (including internal memory 2025, removable medium 2030, and external storage medium 2045), and any peripheral device communicatively coupled with communication interface 2040 (including a network information server or other network device). These non-transitory computer-readable media are means for providing executable code, programming instructions, software, and/or other data to system 2000.

In an embodiment that is implemented using software, the software may be stored on a computer-readable medium and loaded into system 2000 by way of removable medium 2030, I/O interface 2035, or communication interface 2040. In such an embodiment, the software is loaded into system 2000 in the form of electrical communication signals 2055. The software, when executed by processor 2010, preferably causes processor 2010 to perform one or more of the processes and functions described elsewhere herein.

In an embodiment, I/O interface 2035 provides an interface between one or more components of system 2000 and one or more input and/or output devices. Example input devices include, without limitation, sensors, keyboards, touch screens or other touch-sensitive devices, cameras, biometric sensing devices, computer mice, trackballs, pen-based pointing devices, and/or the like. Examples of output devices include, without limitation, other processing devices, cathode ray tubes (CRTs), plasma displays, light-emitting diode (LED) displays, liquid crystal displays (LCDs), printers, vacuum fluorescent displays (VFDs), surface-conduction electron-emitter displays (SEDs), field emission displays (FEDs), and/or the like. In some cases, an input and output device may be combined, such as in the case of a touch panel display (e.g., in a smartphone, tablet, or other mobile device).

System 2000 may also include optional wireless communication components that facilitate wireless communication over a voice network and/or a data network (e.g., in the case of user system 1030). The wireless communication components comprise an antenna system 2070, a radio system 2065, and a baseband system 2060. In system 2000, radio frequency (RF) signals are transmitted and received over the air by antenna system 2070 under the management of radio system 2065.

In an embodiment, antenna system 2070 may comprise one or more antennae and one or more multiplexors (not shown) that perform a switching function to provide antenna system 2070 with transmit and receive signal paths. In the receive path, received RF signals can be coupled from a multiplexor to a low noise amplifier (not shown) that amplifies the received RF signal and sends the amplified signal to radio system 2065.

In an alternative embodiment, radio system 2065 may comprise one or more radios that are configured to communicate over various frequencies. In an embodiment, radio system 2065 may combine a demodulator (not shown) and modulator (not shown) in one integrated circuit (IC). The demodulator and modulator can also be separate components. In the incoming path, the demodulator strips away the RF carrier signal leaving a baseband receive audio signal, which is sent from radio system 2065 to baseband system 2060.

If the received signal contains audio information, then baseband system 2060 decodes the signal and converts it to an analog signal. Then the signal is amplified and sent to a speaker. Baseband system 2060 also receives analog audio signals from a microphone. These analog audio signals are converted to digital signals and encoded by baseband system 2060. Baseband system 2060 also encodes the digital signals for transmission and generates a baseband transmit audio signal that is routed to the modulator portion of radio system 2065. The modulator mixes the baseband transmit audio signal with an RF carrier signal, generating an RF transmit signal that is routed to antenna system 2070 and may pass through a power amplifier (not shown). The power amplifier amplifies the RF transmit signal and routes it to antenna system 2070, where the signal is switched to the antenna port for transmission.

Baseband system 2060 is also communicatively coupled with processor(s) 2010. Processor(s) 2010 may have access to data storage areas 2015 and 2020. Processor(s) 2010 are preferably configured to execute instructions (i.e., computer programs, such as the disclosed software) that can be stored in main memory 2015 or secondary memory 2020. Computer programs can also be received from baseband processor 2060 and stored in main memory 2010 or in secondary memory 2020, or executed upon receipt. Such computer programs, when executed, enable system 2000 to perform the various functions of the disclosed embodiments.

2. Process Overview

Embodiments of processes for the inclinable exercise device system(s) have been shown and/or described herein. It should be understood that the described processes may be embodied in one or more software modules that are executed by one or more hardware processors (e.g., processor 2010), for example, as a software application discussed (e.g., server application 1012, client application 1032, and/or a distributed application comprising both server application 1012 and client application 1032), which may be executed wholly by processor(s) of platform 1010, wholly by processor(s) of user system(s) 1030, or may be distributed across platform 1010 and user system(s) 1030, such that some portions or modules of the software application are executed by platform 1010 and other portions or modules of the software application are executed by user system(s) 1030. The described processes may be implemented as instructions represented in source code, object code, and/or machine code. These instructions may be executed directly by hardware processor(s) 2010, or alternatively, may be executed by a virtual machine operating between the object code and hardware processors 2010. In addition, the disclosed software may be built upon or interfaced with one or more existing systems.

Alternatively, the described processes may be implemented as a hardware component (e.g., general-purpose processor, integrated circuit (IC), application-specific integrated circuit (ASIC), digital signal processor (DSP), field-programmable gate array (FPGA) or other programmable logic device, discrete gate or transistor logic, etc.), combination of hardware components, or combination of hardware and software components. To clearly illustrate the interchangeability of hardware and software, various illustrative components, blocks, modules, circuits, and steps are described herein generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a component, block, module, circuit, or step is for ease of description. Specific functions or steps can be moved from one component, block, module, circuit, or step to another without departing from the invention.

Furthermore, while the processes, described herein, are illustrated with a certain arrangement and ordering of subprocesses, each process may be implemented with fewer, more, or different subprocesses and a different arrangement and/or ordering of subprocesses. In addition, it should be understood that any subprocess, which does not depend on the completion of another subprocess, may be executed before, after, or in parallel with that other independent subprocess, even if the subprocesses are described or illustrated in a particular order.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

We claim:

1. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein the tower includes a top, and further comprising one or more modular monitor mounts adjustably coupled to the top of the tower, wherein the one or more modular monitor mounts include a bottom, and the top of the tower includes a slot that receives the bottom of the one or more modular monitor mounts.

2. The exercise device system of claim 1, wherein the monitor mount includes a pivot member that allows a mounted monitor to pivot downwards and upwards.

3. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein the movable user support platform includes a bottom member with a weight-receiving section therein, and a top member that covers the bottom member and weight-receiving section.

4. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein the movable user support platform includes a recess, the pulley system includes a pulley in the recess, and a top member covering the recess and the pulley in the recess.

5. The exercise device system of claim 4, wherein the exercise device system includes a foot platform including a cap that is actuatable movably outwardly to release the foot platform and replace it with a different accessory.

6. The exercise device system of claim 5, wherein the tower includes a rear with a weight rack including a plurality of weight shelves configured to hold weights.

7. The exercise device system of claim 5, wherein the tower includes a plurality of accessory attachment members configured to attach a plurality of accessories thereto.

8. The exercise device system of claim 5, further including a carriage movably coupled to the support structure to move vertically with respect to the tower to incline the support structure at different angles relative to the tower, the carriage including handle docking stations that exercise handles for the exercise device system are dockable within.

9. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein the exercise device handles each include a rechargeable battery, the exercise device system includes a cabinet that stores the tower, the support structure, and the movable user support platform when not in use, and includes magnetic and charging receptacles that magnetically receive and charge the rechargeable batteries of the exercise device handles.

10. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein at least one of the support structure and the movable user support platform include a rechargeable battery, the exercise device system includes a cabinet that stores the tower, the support structure, and the movable user support platform when not in use and charges the rechargeable battery of at least one of the support structure and the movable user support platform.

11. The exercise device system of claim 5, further including a skeletal tracking system configured to track a plurality of body points.

12. The exercise device system of claim 5, wherein the exercise device system includes a foot platform with a top, and further comprising one or more cameras located at or adjacent to the top of the foot platform.

13. The exercise device system of claim 5, wherein the movable user support platform includes an integrated fabric pressure mapping system to determine and track posture of the user.

14. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, further including one or more light emitting sources carried by the movable user support platform, one or more light receivers, and one or more processors that when executing one or more software modules, is configured to:

transmit signals to cause emission of light from the one or more light emitting sources carried by the movable user support platform as the movable user support platform moves relative to the support structure at an inclination angle relative to the tower;

receive incoming signals via the one or more light receivers to determine distance the movable user support platform travels relative to the support structure at the inclination angle relative to the tower;

calculate velocity of the movable user support platform based on the determined distance the movable user support platform travels as the movable user support platform travels relative to the support structure at the inclination angle relative to the tower.

15. The exercise device system of claim 5, wherein the exercise device handles include integrated IR LEDs.

16. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, wherein the exercise device handles each include a rechargeable battery and charging contacts.

17. The exercise device system of claim 5, wherein the exercise device handles each include Inertial Measurement Unit sensors.

18. The exercise device system of claim 5, wherein the exercise device handles are configured to wirelessly stream data from the handles.

19. The exercise device system of claim 5, further including a foot platform with an upper surface and a display incorporated therein.

20. The exercise device system of claim 19, wherein the display is a transparent flexible organic light-emitting diode (OLED) display.

21. The exercise device system of claim 19, wherein the display is a head-up display (HUD) using polycarbonate backed with clear projection film.

22. The exercise device system of claim 5, further including a cabinet and a deployment and retraction mechanism to deploy and retract the support structure with respect to the cabinet.

23. An exercise device system, comprising:

a tower;

a support structure inclinable at different angles relative to the tower;

a movable user support platform movably associated with the support structure for movement relative to the support structure;

a pulley system associated with the movable user support platform;

a cable extending through the pulley system and including opposite ends;

exercise device handles coupled to the opposite ends of the cable, whereby movement of the handles causes movement of the movable user support platform relative to the support structure, further including a cabinet and a deployment and retraction mechanism to deploy and retract the support structure with respect to the cabinet, wherein the deployment and retraction mechanism includes one of:

a stationary ring gear, a motor with a sun gear, and a satellite gear;

a stationary ring gear, and a motor and gear; and a motor with gear, a stationary gear, and a belt drive.

24. The exercise device system of claim 5, wherein the exercise device system is one of numerous versions of the exercise device system, the numerous versions of the exercise device system having a common fundamental inclined bench hub and different bases and different accessories to create a personalized, unique inclinable exercise device system.

25. The exercise device system of claim 5, further including a modular system add-on having a high-tech display screen that conceals underlying technology while emphasizing user vitals.

26. The exercise device system of claim 5, wherein further including a light-weight 3D body scan mat.

* * * * *